US010518331B2

(12) United States Patent
Mirkin et al.

(10) Patent No.: US 10,518,331 B2
(45) Date of Patent: Dec. 31, 2019

(54) SYNTHESIS OF UNIFORM ANISOTROPIC NANOPARTICLES

(71) Applicant: NORTHWESTERN UNIVERSITY, Evanston, IL (US)

(72) Inventors: Chad A. Mirkin, Wilmette, IL (US); Matthew R. Jones, LaMesa, CA (US); Matthew N. O'Brien, Plymouth, MN (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 283 days.

(21) Appl. No.: 15/324,283

(22) PCT Filed: Jul. 13, 2015

(86) PCT No.: PCT/US2015/040111
§ 371 (c)(1),
(2) Date: Jan. 6, 2017

(87) PCT Pub. No.: WO2016/007942
PCT Pub. Date: Jan. 14, 2016

(65) Prior Publication Data

US 2017/0203369 A1 Jul. 20, 2017

Related U.S. Application Data

(60) Provisional application No. 62/023,398, filed on Jul. 11, 2014.

(51) Int. Cl.
*B22F 9/24* (2006.01)
*B22F 1/00* (2006.01)

(52) U.S. Cl.
CPC ..... *B22F 9/24* (2013.01); *B22F 1/0018* (2013.01); *B22F 1/0048* (2013.01); *B22F 2001/0033* (2013.01)

(58) Field of Classification Search
None
See application file for complete search history.

(56) References Cited

U.S. PATENT DOCUMENTS

| | | | | |
|---|---|---|---|---|
| 8,048,193 | B2 | 11/2011 | Taniuchi et al. | |
| 2005/0056118 | A1* | 3/2005 | Xia | B22F 1/0007 75/330 |
| 2006/0266157 | A1* | 11/2006 | Takata | B22F 1/0025 75/255 |
| 2014/0048420 | A1* | 2/2014 | Chen | C25D 5/54 205/157 |
| 2018/0065842 | A1* | 3/2018 | Yerushalmi | B82B 1/001 |

OTHER PUBLICATIONS

Ali et al., Synthesis and optical properties of small Au nanorods using a seedless growth technique, Langmuir, 28(25):9807-15 (2012).

(Continued)

*Primary Examiner* — George Wyszomierski
(74) *Attorney, Agent, or Firm* — Marshall, Gerstein & Borun LLP

(57) ABSTRACT

Methods of synthesizing various metal nanoparticle structures having high uniformity, using iterative reduction and oxidation conditions, is provided herein.

20 Claims, 18 Drawing Sheets

(56) References Cited

OTHER PUBLICATIONS

Anker et al., Biosensing with plasmonic nanosensors, Nat. Mater., 7(6):442-53 (2008).
Atwater et al., Plasmonics for improved photovoltaic devices, Nat. Mater., 9(3):205-13 (2010).
Bishop et al., Nanoscale forces and their uses in self-assembly, Small, 5(14):1600-30 (2009).
Blaber et al., LSPR Imaging of Silver Triangular Nanoprisms: Correlating Scattering with Structure Using Electrodynamics for Plasmon Lifetime Analysis, J. Phys. Chem. C, 116(1):393-403 (2012).
Brown et al., Seeding of Colloidal Au Nanoparticle Solutions. 2. Improved Control of Particle Size and Shape, Chem. Mater., 12(2):306-13 (2000).
Caswell et al., Preferential end-to-end assembly of gold nanorods by biotin-streptavidin connectors, J. Am. Chem. Soc., 125(46):13914-5 (2003).
Chaudhuri et al., Core/Shell Nanoparticles: Classes, Properties, Synthesis Mechanisms, Characterization, and Applications, Chem. Rev., 112(4):2373-433 (2012).
Chen et al., High-Yield Seedless Synthesis of Triangular Gold Nanoplates through Oxidative Etching, Nano Lett., 14(12):7201-6 (2014).
Dabbousi et al., (CdSe)ZnS Core-Shell Quantum Dots:? Synthesis and Characterization of a Size Series of Highly Luminescent Nanocrystallites, J. Phys. Chem. B, 101(46):9463-75 (1997).
Draine et al., Discrete-Dipole Approximation for Scattering Calculations, J. Opt. Soc. Am. A, 11(4):1491-9 (1994).
Elechiguerra et al., The role of twinning in shape evolution of anisotropic noble metal nanostructures, J. Mater. Chem., 16:3906-19 (2006).
Engheta, Circuits with light at nanoscales: optical nanocircuits inspired by metamaterials, Science, 317(5845):1698-702 (2007).
Glotzer et al., Anisotropy of building blocks and their assembly into complex structures, Nat. Mater., 6(8):557-62 (2007).
Gole et al., Seed-Mediated Synthesis of Gold Nanorods:? Role of the Size and Nature of the Seed, Chem. Mater., 16(19):3633-40 (2004).
Grzelczak et al., Shape control in gold nanoparticle synthesis, Chem. Soc. Rev., 37(9):1783-91 (2008).
Halas, Playing with Plasmons: Tuning the Optical Resonant Properties of Metallic Nanoshells, 30(5):362-7 (2005).
Hartland, Optical Studies of Dynamics in Noble Metal Nanostructures, Chem. Rev., 111(6):3858-87 (2011).
Hong et al., Au Nanodisk-Core Multishell Nanoparticles: Synthetic Method for Controlling Number of Shells and Intershell Distance, Chem. Mater., 26(12):3618-23 (2014).
Hong et al., Shape Transformation of Gold Nanoplates and their Surface Plasmon Characterization: Triangular to Hexagonal Nanoplates, Chem. Mater., 23(8):2011-3 (2011).
International Preliminary Report on Patentability, International Application No. PCT/US2015/040111, dated Jan. 17, 2017.
International Search Report and Written Opinion, International Application No. PCT/US15/40111, dated Oct. 19, 2015.
Jain et al., Calculated Absorption and Scattering Properties of Gold Nanoparticles of Different Size, Shape, and Composition: Applications in Biological Imaging and Biomedicine, J. Phys. Chem. B, 110(14):7238-48 (2006).
Jones et al., Bypassing the limitations of classical chemical purification with DNA-programmable nanoparticle recrystallization, Angew. Chem. Int. Ed. Engl., 52(10):2886-91 (2013).
Jones et al., DNA-nanoparticle superlattices formed from anisotropic building blocks, Nat. Mater., 9(11):913-7 (2010).
Jones et al., Nanoparticle shape anisotropy dictates the collective behavior of surface-bound ligands, J. Am. Chem. Soc., 133(46):18865-9 (2011).
Jones et al., Templated techniques for the synthesis and assembly of plasmonic nanostructures, Chem. Rev., 111(6):3736-827 (2011).
Kelly et al., The Optical Properties of Metal Nanoparticles:? The Influence of Size, Shape, and Dielectric Environment, J. Phys. Chem. B, 107(3):668-77 (2003).
Lal et al., Tailoring plasmonic substrates for surface enhanced spectroscopies, Chem. Soc. Rev., 37(5):898-911 (2008).
Langille et al., Defining rules for the shape evolution of gold nanoparticles, J. Am. Chem. Soc., 134(35):14542-54 (2012).
Langille et al., Stepwise evolution of spherical seeds into 20-fold twinned icosahedra, Science, 337(6097):954-7 (2012).
Lee et al., Ultrasmooth, highly spherical monocrystalline gold particles for precision plasmonics, ACS Nano, 7(12):11064-70 (2013).
Liao et al., Gold Nanorod Bioconjugates, Chem. Mater., 17(18):4636-41 (2005).
Linic et al., Plasmonic-metal nanostructures for efficient conversion of solar to chemical energy, Nat. Mater., 10(12):911-21 (2011).
Link et al., Size and Temperature Dependence of the Plasmon Absorption of Colloidal Gold Nanoparticles, J. Phys. Chem. B, 103(21):4212-7 (1999).
Link et al., Spectral Properties and Relaxation Dynamics of Surface Plasmon Electronic Oscillations in Gold and Silver Nanodots and Nanorods, J. Phys. Chem. B, 103(40):8410-26 (1999).
Liu et al., Mechanism of silver(I)-assisted growth of gold nanorods and bipyramids, J. Phys. Chem. B, 109(47):22192-200 (2005).
Lofton et al., Mechanisms Controlling Crystal Habits of Gold and Silver Colloids, Adv. Funct. Mater., 15:1197-208 (2005).
Lohse et al., Anisotropic Noble Metal Nanocrystal Growth: The Role of Halides, Chem. Mater., 26(1): 34-43 (2014).
Lohse et al., The Quest for Shape Control: A History of Gold Nanorod Synthesis, Chem. Mater., 25(8):1250-61 (2013).
Lu et al., Truncated Ditetragonal Gold Prisms as Nanofacet Activators of Catalytic Platinum, J. Am. Chem. Soc., 133(45):18074-7 (2011).
Macfarlane et al., Nanoparticle superlattice engineering with DNA, Science, 334(6053):204-8 (2011).
Millstone et al., Colloidal Gold and Silver Triangular Nanoprisms, Small, 5(6):646-64 (2009).
Millstone et al., Iodide Ions Control Seed-Mediated Growth of Anisotropic Gold Nanoparticles, Nano Lett., 8(8):2526-9 (2008).
Millstone et al., Observation of a Quadrupole Plasmon Mode for a Colloidal Solution of Gold Nanoprisms, J. Am. Chem. Soc., 127(15):5312-3 (2005).
Ming et al., Growth of Tetrahexahedral Gold Nanocrystals with High-Index Facets, J. Am. Chem. Soc., 131(45):16350-1 (2009).
Mirkin et al., A DNA-based method for rationally assembling nanoparticles into macroscopic materials, Nature, 382(6592):607-9 (1996).
Munechika et al., Plasmon Line Widths of Single Silver Nanoprisms as a Function of Particle Size and Plasmon Peak Position, J. Phys. Chem. C, 111(51):18906-11 (2007).
Murray et al., Synthesis and characterization of nearly monodisperse CdE (E = sulfur, selenium, tellurium) semiconductor nanocrystallites, J. Am. Chem. Soc., 115(19): 8706-15 (1993).
Near et al., Rapid and Efficient Prediction of Optical Extinction Coefficients for Gold Nanospheres and Gold Nanorods, J. Phys. Chem. C, 117(45):23950-5 (2013).
Nikoobakht et al., Preparation and Growth Mechanism of Gold Nanorods (NRs) Using Seed-Mediated Growth Method, Chem. Mater., 15(10):1957-62 (2003).
Niu et al., Selective synthesis of single-crystalline rhombic dodecahedral, octahedral, and cubic gold nanocrystals, J. Am. Chem. Soc., 131(2):697-703 (2009).
O'Brien et al., Langmuir analysis of nanoparticle polyvalency in DNA-mediated adsorption, Angew. Chem. Int. Ed. Engl., 53(36):9532-8 (2014).
O'Brien et al., Universal noble metal nanoparticle seeds realized through iterative reductive growth and oxidative dissolution reactions, J. Am. Chem. Soc., 136(21):7603-6 (2014).
Orendorff et al., Quantitation of Metal Content in the Silver-Assisted Growth of Gold Nanorods, J. Phys. Chem. B, 110(9):3990-4 (2006).

(56) References Cited

OTHER PUBLICATIONS

Personick et al., Making sense of the mayhem behind shape control in the synthesis of gold nanoparticles, J. Am. Chem. Soc., 135(49):18238-47 (2013).
Personick et al., Shape Control of Gold Nanoparticles by Silver Underpotential Deposition, Nano Lett., 11(8):3394-8 (2011).
Purcell et al., Scattering and absorption of light by nonspherical dielectric grains, The Astrophysical Journal, 186:705-14 (1973).
Rodriguez-Fernandez et al., Spatially-directed oxidation of gold nanoparticles by Au(III)-CTAB complexes, J. Phys. Chem. B, 109(30):14257-61 (2005).
Rosi et al., Nanostructures in biodiagnostics, Chem. Rev., 105(4):1547-62 (2005).
Sau et al., Room Temperature, High-Yield Synthesis of Multiple Shapes of Gold Nanoparticles in Aqueous Solution, J. Am. Chem. Soc., 126(28):8648-9 (2004).
Scarabelli et al., Monodisperse Gold Nanotriangles: Size Control, Large-Scale Self-Assembly, and Performance in Surface-Enhanced Raman Scattering, ACS Nano, 8(6):5833-42 (2014).
Schuller et al., Plasmonics for extreme light concentration and manipulation, Nat. Mater., 9(3):193-204 (2010).
Seo et al., Polyhedral Gold Nanocrystals with $O_h$ Symmetry: From Octahedra to Cubes, J. Am. Chem. Soc., 128(46):14863-70 (2006).
Shevchenko et al., Structural diversity in binary nanoparticle superlattices, Nature, 439(7072):55-9 (2006).
Shuford et al., Multipolar excitation in triangular nanoprisms, J. Chem. Phys., 123(11):114713 (2005).
Skrabalak et al., Gold nanocages: synthesis, properties, and applications, Acc. Chem. Res., 41(12):1587-95 (2008).
Sohn et al., Construction of evolutionary tree for morphological engineering of nanoparticles, ACS Nano, 3(8):2191-8 (2009).
Stebe et al., Materials science. Oriented assembly of metamaterials, Science, 325(5937):159-60 (2009).
Stiles et al., Surface-enhanced Raman spectroscopy, Annu. Rev. Anal. Chem., 1:601-26 (2008).
Tao et al., Shape control of colloidal metal nanocrystals, Small, 4(3):310-25 (2008).
Tsung et al., Selective shortening of single-crystalline gold nanorods by mild oxidation, J. Am. Chem. Soc., 128(16):5352-3 (2006).
Walker et al., Geometric curvature controls the chemical patchiness and self-assembly of nanoparticles, Nat. Nanotechnol., 8(9):676-81 (2013).
Willets et al., Localized surface plasmon resonance spectroscopy and sensing, Annu. Rev. Phys. Chem., 58:267-97 (2007).
Wu et al., Seed-mediated synthesis of gold nanocrystals with systematic shape evolution from cubic to trisoctahedral and rhombic dodecahedral structures, Langmuir, 26(14):12307-13 (2010).
Xia et al., One-Dimensional Nanostructures: Synthesis, Characterization, and Applications, Adv. Mater., 15(5):353-89 (2003).
Xia et al., Shape-controlled synthesis of metal nanocrystals: simple chemistry meets complex physics, Angew. Chem. Int. Ed. Engl., 48(1):60-103 (2009).
Ye et al., Improved Size-Tunable Synthesis of Monodisperse Gold Nanorods through the Use of Aromatic Additives, ACS Nano, 6(3):2804-17 (2012).
Ye et al., Using Binary Surfactant Mixtures to Simultaneously Improve the Dimensional Tunability and Monodispersity in the Seeded Growth of Gold Nanorods, Nano Lett., 13(2):765-71 (2013).
Young et al., Assembly of reconfigurable one-dimensional colloidal superlattices due to a synergy of fundamental nanoscale forces, Proc. Natl. Acad. Sci. USA, 109(7): 2240-5 (2012).
Yurkin et al., The discrete dipole approximation: An overview and recent developments, J. Quantitative Spectroscopy and Radiative Transfer, 106 (1-3):558-89 (2007).
Zhang et al., Concave Cubic Gold Nanocrystals with High-Index Facets, J. Am. Chem. Soc., 132(40):14012-4 (2010).

* cited by examiner

SYNTHESIS OF UNIFORM ANISOTROPIC NANOPARTICLES

CROSS-REFERENCE TO RELATED APPLICATIONS

The benefit under 35 U.S.C. § 119 of U.S. Provisional Application No. 62/023,398, filed Jul. 11, 2014, is claimed, the disclosure of which is incorporated by reference in its entirety herein.

STATEMENT OF GOVERNMENTAL INTEREST

This invention was made with government support under DE-SC0000989 awarded by the Department of Energy; DMR 1121262 awarded by the National Science Foundation; FA9950-09-1-0294and FA9550-11-0275awarded by the Air Force Office of Scientific Research. The government has certain rights in the inventon.

BACKGROUND

Gold nanoparticles have found use in biology, medicine, electronics, materials science, and chemistry due to their stability, their well-established surface chemistry, and the ability to tune how they interact with light. However, their ultimate utility requires each individual nanoparticle to be representative of the whole, such that behavior of individual species is reproducible, reliable, and can be determined from bulk measurements.

While methods exist to control the uniformity of pseudo-spherical- and rod-shaped gold nanoparticles, the yield and uniformity of other nanoparticle shapes are more difficult to control. Thus, a need exists for methods of synthesizing nanoparticles of uniform shape.

SUMMARY

Provided herein are methods of preparing circular disk nanoparticles. The methods comprise (a) admixing gold triangular prisms, a stabilizing agent, and an oxidizing agent in an aqueous solution to form a first intermediate; (b) admixing the first intermediate, a gold salt, and a reducing agent, and optionally a base and halide salt, in an aqueous solution to form a second intermediate; (c) admixing the second intermediate, a stabilizing agent, and oxidizing agent in an aqueous solution to form the gold circular disk nanoparticles; and (d) optionally repeating steps (b) and (c) at least once to increase the uniformity of the resulting circular disk nanoparticles; wherein the gold circular disk nanoparticles are formed in a yield of at least 70%. The dissolution step of step (b) and the growth step of step (c) can be repeated at least twice. The circular disk nanoparticles can be formed in a yield of at least 90%, or at least 95%. The circular disk nanoparticles can have a coefficient of variation (CV) of less than 30%, 10% or less, or 5% or less.

In various cases, the oxidizing agent comprises $HAuCl_4$. In some cases, the concentration of the oxidizing agent can be selected based upon the edge length of the triangular prism: for example, at 8 μM for an edge length of 60 nm or less; at 10 μM for an edge length of 80 nm to 120 nm; at 12 μM for an edge length of 140 nm; and at 13 μM for an edge length of 180 nm.

In various cases, the stabilizing agent is selected from the group consisting of cetyltrimethylammonium bromide (CTAB), cetyltrimethylammonium chloride (CTAC), cetylpyridinium chloride (CPC), and a mixture thereof.

In some cases, the gold salt comprises $HAuCl_4$.

In various cases, the reducing agent comprises ascorbic acid.

In cases where the base and halide are present in step (c), the base can comprise sodium hydroxide. In some cases, the halide salt is selected from the group consisting of LiCl, KCl, NaCl, RbCl, KBr, NaBr, $MgCl_2$, $CaBr_2$, LiI, KI, NaI, and a mixture thereof.

In some cases, the triangular prisms are prepared by admixing a stabilizing agent, an iodide salt, a gold salt, a base, a reducing agent, and nanoparticle seeds to form triangular prisms; and isolating the gold triangular prisms. In various cases, the concentration of the nanoparticle seeds is 20 to 300 pM for a selected edge length of the triangular prisms of 30 nm to 250 nm. The iodide salt can be NaI. The base can comprise NaOH. The gold salt can comprise $HAuCl_4$. In various cases, the isolating comprises adding a halide salt to the mixture resulting from step (1). In some cases, the halide salt is selected from the group consisting of LiCl, KCl, NaCl, RbCl, KBr, NaBr, $MgCl_2$, $CaBr_2$, LiI, KI, NaI, and a mixture thereof. In some cases, the halide salt comprises NaCl. The halide salt concentration is selected in view of the edge length of the triangular prism: 0.4 M halide salt for triangular prisms with an edge length of 30 nm to 80 nm; 0.2 M halide salt for triangular prisms with an edge length of 90 nm to 120 nm; 0.1 M halide salt for triangular prisms with an edge length of 130 nm to 170 nm; and 0.05 M halide salt for triangular prisms with an edge length of 180 nm to 250 nm.

Further provided are methods of preparing hexagonal prisms by admixing the circular disk nanoparticles, an iodide salt, a stabilizing agent, a gold salt, a base, and a reducing agent to form the gold hexagonal prism. The uniformity of the hexagonal prism can be less than 30% CV, or 10% or less. The iodide salt can comprise NaI. The stabilizing agent can comprise CTAB, CTAC, CPC, or a mixture thereof. The gold salt can comprise $HAuCl_4$. The base can comprise NaOH. The reducing agent can comprise ascorbic acid.

Further provided are methods of preparing triangular prisms by admixing the circular disk nanoparticles, an iodide salt, a stabilizing agent, a gold salt, a base, and a reducing agent to form the gold triangular prism nanoparticles. The uniformity of the triangular prism can be less than 30% CV, or 10% or less. The iodide salt can comprise NaI. The stabilizing agent can comprise CTAB, CTAC, CPC, or a mixture thereof. The gold salt can comprise $HAuCl_4$. The base can comprise NaOH. The reducing agent can comprise ascorbic acid.

Further provided are methods of preparing triangular bipyramid prisms comprising admixing the circular disk nanoparticles, a stabilizing agent, a gold salt, a base, and a reducing agent to form the triangular bipyramid prisms. Also provided are methods of preparing hexagonal bipyramid prisms comprising admixing the circular disk nanoparticles, a stabilizing agent, a gold salt, a base, and a reducing agent to form the hexagonal bipyramid prisms.

Also provided herein are methods of preparing gold spherical nanoparticles comprising (a) admixing gold nanorods, a stabilizing agent, and an oxidizing agent in an aqueous solution to form a first intermediate; (b) admixing the first intermediate, a gold salt, and a reducing agent, and optionally a base and halide salt, in an aqueous solution to form a second intermediate; (c) admixing the second intermediate, a stabilizing agent, and an oxidizing agent in an aqueous solution to form the gold spherical nanoparticles; and (d) optionally repeating steps (b) and (c) at least once to increase the uniformity of the resulting gold spherical nanoparticles, as measured by a coefficient of variation (CV); wherein (1) the method is performed in the absence of ethylene glycol, dimethylformamide, diethylene glycol, dimethylsulfoxide, toluene, tetrahydrofuran, hexane, octane, and oleic acid; (2) the gold spherical nanoparticles are formed in a yield of at least 90%; and (3) the gold spherical nanoparticles have a diameter of 1 nm to 99 nm. The dissolution step of step (b) and the growth step of step (c) can be repeated at least twice. The resulting spherical nanoparticles can have a CV of 5% or less, or of 3% or less.

The stabilizing agent can comprise CTAB, CTAC, CPC, or a mixture thereof. The oxidizing agent can comprise $HAuCl_4$. The gold salt can comprise $HAuCl_4$. The reducing agent can comprise ascorbic acid.

In cases where the base and halide are present in step (c), the base can comprise sodium hydroxide. In some cases, the halide salt is selected from the group consisting of LiCl, KCl, NaCl, RbCl, KBr, NaBr, $MgCl_2$, $CaBr_2$, LiI, KI, NaI, and a mixture thereof.

In various cases, any one of steps (a), (b), and (c) is performed for 0.5 hr to 6 hr, or 0.5 hr to 2 hr. In various cases, each of steps (a), (b), and (c) is performed for 0.5 hr to 6 hr, or 0.5 hr to 2 hr.

Further provided are methods of making various shaped nanoparticles from the spherical nanoparticles: cube nanoparticles, concave cube nanoparticles, octahedra nanoparticles, cuboctahedra nanoparticles, rhombic dodecahedra nanoparticles, truncated ditetragonal prisms, tetrahexahedra bipyramid nanoparticles, hexagonal bipyramid nanoparticles, concave rhombic dodecahedra nanoparticles.

DETAILED DESCRIPTION

Figure 1:
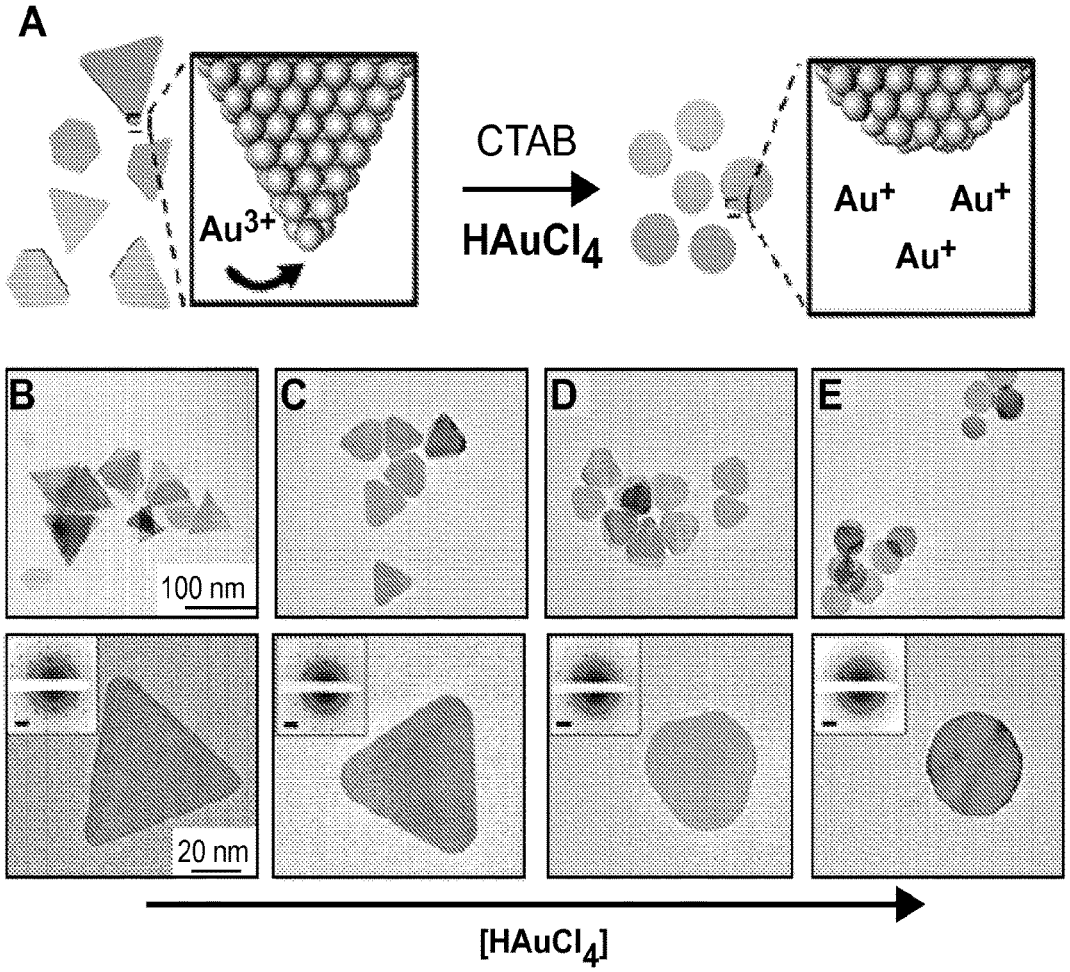
FIG. 1 shows the transformation of gold triangular prisms into circular disks through a conproportionation reaction. (A) Triangular prisms can be oxidized by $HAuCl_4$ in the presence of CTAB. The reaction selectively removes surface atoms with the lowest metal coordination number. (B)-(D) TEM images taken of triangular prisms treated with increasing oxidizing agent concentration confirm that the reaction proceeds in a tip-selective fashion and reduces the size and shape dispersity of the starting material. Insets show selected area electron diffraction patterns, which confirm that the dissolution process does not change the exposed {11111} facet; scale bars are 5 $nm^{-1}$.

Provided herein are methods of iterative growth and dissolution reactions to sequentially improve the structural uniformity of nanoparticle precursors (e.g., how uniform these nanoparticles are in shape, size, and/or crystal defect structure). These nanoparticle precursors can then be used as "seeds," or templates, for the subsequent growth of nanoparticles with different shapes. Importantly, the use of these uniform seeds overcomes many current limitations with nanoparticle syntheses and allows access to nanoparticles with less than 15% variation in size (e.g., less than 10 or less than 5% variation in size) and in yields of greater than 95%, from the same batch of precursors. This chemistry can be used for different types of nanoparticle seeds (e.g., gold nanoparticles with different crystalline defect structures and shapes), which allows access to uniform one-, two-, and three-dimensional structures. All nanoparticles are synthesized in an aqueous environment, which enables facile post-synthesis modification with a desired surface ligand.

Use of these nanoparticles can be for a variety of applications including: diagnostics and detection, based upon plasmonic or plasmon-exciton interactions; therapeutics, based upon the arrangement and delivery of small molecules, biomolecules, or other organic materials; as building blocks for constructing-nanoparticle based materials (with metamaterial, photonic, plasmonic, electronic, optoelectronic properties) or self-assembly; surface-enhanced Raman spectroscopy; and/or nanoparticle catalysis.

The technology described here utilizes an iterative two-step process of growth and dissolution for the stepwise refinement of nanoparticles. This process is shown here with two different starting nanoparticles—either gold nanorods or gold triangular prisms. This chemistry can be extended to other noble metal shapes and defect structures, or other compositions given the appropriate dissolution and growth chemistry.

The first step following the generation of these precursor particles is dissolution. Briefly, an initial nanoparticle solution (of nanorods or triangular prisms) is subjected to dissolution with an oxidizing agent, in the presence of a stabilizing agent in an aqueous solution, the solution stirred, and the reaction allowed to sit for a certain time (e.g., 0.5-6 hours, or four hours) to allow for oxidation. This results in the site-selective oxidation of the initial nanoparticles at the tips/high-energy features and the simultaneous reduction of the oxidizing agent. This also results in final shapes of spheres and circular disks for initial nanorod and triangular prism morphologies, respectively. The spheres or circular disks can then subsequently be subjected to growth conditions and an additional dissolution step to increase the uniformity of the resulting spheres or circular disks. Multiple repetitions of growth then oxidation can be performed (e.g., once, twice, or three times, or more) to further refine the uniformity of the materials. With each round of dissolution and growth, the uniformity of the spheres and circular disks improves. For example, if this process is repeated at least twice for initial gold nanorod precursor, the uniformity of the nanoparticles can be improved to a less than 5% variation in particle size (CV), or 3% or less CV, with even further improvement with additional rounds.

Refined precursors (spheres or circular disks) can then subsequently be used as "seeds" or templates to grow a range of nanoparticle sizes and shapes. Size can be tuned based upon the identity/concentration of the stabilizing agent and/or reducing agent, the rate of reaction (pH, temperature) and the concentration of additives (e.g., halide salts, silver salts). For example spherical nanoparticle seeds can be used to produce cubes, octahedra, rhombic dodecahedra, concave cubes, concave rhombic dodecahedra, truncated ditetragonal prisms, tetrahexahedra (convex cubes), and cuboctahedra. Circular disk nanoparticle seeds can be used to produce hexagonal and triangular prisms, as well as hexagonal and triangular bipyramids.

Thus, provided herein are methods of preparing circular disk nanoparticle seeds comprising subjecting the starting gold triangular prisms to dissolution conditions—admixing gold triangular prisms, oxidizing agent, and a stabilizing agent in an aqueous solution, to form a first intermediate. The first intermediate is then subjected to growth conditions—admixing the first intermediate, a gold salt, and a reducing agent (optionally with a base and a halide salt) to form a second intermediate. The second intermediate is then subjected to dissolution conditions again—admixing the second intermediate, an oxidizing agent and a stabilizing agent in an aqueous solution to form the circular disk nanoparticle seeds. Additional growth and dissolution steps can be performed to increase the uniformity of the resulting circular disk nanoparticle seeds, for example one, two, three, or four additional rounds of growth and dissolution.

As used herein, the term "dissolution" refers to reaction of a nanoparticle with an oxidizing agent in the presence of a stabilizing agent to dissolve the nanoparticle. Such dissolution can preferentially occur at the sites with lower coordination number (e.g., the tips of the nanoparticle).

As used herein, the term "growth" refers to a reaction of a nanoparticle with a reducing agent, a gold salt, and optionally a base and halide salt to reduce the gold salt and deposit $Au^0$ on the surface of the nanoparticle, thereby "growing" the nanoparticle.

As used herein, the stabilizing agent is a quaternary ammonium halide salt, wherein the nitrogen is substituted with four substituents selected from alkyl, aryl, and heteroaryl, and having a molecular weight of less than 1000 g/mol. Non-limiting examples of stabilizing agents include cetyltrimethylammonium bromide (CTAB), cetyltrimethylammonium chloride (CTAC), cetylpyridinium chloride (CPC), and a mixture thereof.

The oxidizing agent can be any agent that oxidizes the metal of the nanoparticle, e.g., gold ($Au^0$ to $Au^+$). One such example of an oxidizing agent is a $Au^{3+}$ salt, such as $HAuCl_4$. Other examples include triiodide salts, cyanide salts (such as KCN), iron (III) salts (such as $Fe(NO_3)_3$), copper (II) salts (such as $CuCl_2$), peroxides (such as $H_2O_2$), and oxygen.

The reducing agent can be any agent that reduces a gold (I) or (III) ion to $Au^0$. Some examples of reducing agents include ascorbic acid, hydrazine, sodium borohydride, sodium oleate, sodium citrate, salicylic acid, sodium sulfide, formic acid, and oxalic acid. In some cases, the reducing agent is ascorbic acid.

The disclosed methods provides circular disk nanoparticle seeds in a yield of at least 70%, and in some cases a yield of at least 80%, at least 90%, at least 95%, or at least 98%. The yield of the method indicates the shape of the resulting nanoparticles. Thus, a yield of at least 70% indicates that 70% or more of the resulting nanoparticles from the reaction are in the designated shape, e.g., a circular disk nanoparticle seed.

The resulting circular disk nanoparticle seeds are uniform, as measured by the variation in their size, characterized by a coefficient of variation (CV). The CV of the resulting seeds can be 30% or less, 20% or less, 10% or less, or 5% or less. Increased repetitions of the growth and dissolution steps can increase the uniformity (e.g., decrease the CV).

The dissolution can be performed at a temperature of about 25° C. to 50° C. In some cases, the temperature of the dissolution is about 28° C. In other cases, the temperature is about 40° C.

The dissolution can be performed at a pH of about 3 to 10. In some cases, the pH is adjusted by the addition of a base, such as sodium hydroxide. In some cases, the pH is adjusted by the addition of hydrochloric acid.

The size of the resulting circular disk nanoparticle seeds is related to the size of the gold triangular prisms undergoing dissolution. Thus, circular disk nanoparticle seeds having a desired diameter can be prepared by appropriate selection of edge length of the gold triangular prisms.

The gold triangular prisms used to prepare the circular disk nanoparticle seeds can be prepared by admixing a gold salt, a stabilizing agent, an iodide salt, a base, a reducing agent and nanoparticle seeds to form the triangular prisms.

The iodide salt can be LiI, NaI, KI, RbI, $MgI_2$, $CaI_2$, or a mixture thereof. In some cases, the iodide salt is NaI.

The base can be a hydroxide base (e.g., NaOH, LiOH, KOH, or mixture thereof). In some cases, the inorganic base comprises NaOH.

The gold salt can be any gold (III) salt. In some cases, the gold salt comprises $HAuCl_4$.

The concentration of nanoparticle seeds determines the edge length of the resulting gold triangular prisms, where the concentration of 20 to 300 pM provides an edge length of about 30 nm to 250 nm. The relationship between concentration and edge length is determined by [Seed]=2062.8* $1^{-0.709}$. The resulting triangular prisms can further be further treated to isolate the triangular prisms by increasing the ionic strength of the solution of the mixture (e.g., by adding a halide salt) or increasing the osmotic pressure (e.g., by adding a depletant). The triangular prisms can be centrifuged to collect from the mixture and resuspended in, e.g., CTAB.

The halide salt can be LiCl, KCl, NaCl, RbCl, KBr, NaBr, $MgCl_2$, $CaBr_2$, LiI, KI, NaI, and a mixture thereof. The concentration of the halide salt can be selected based upon the edge length of the triangular prism: 0.4 M halide salt for triangular prisms with an edge length of 30 nm to 80 nm; 0.2 M halide salt for triangular prisms with an edge length of 90 nm to 120 nm; 0.1 M halide salt for triangular prisms with an edge length of 130 nm to 170 nm; and 0.05 M halide salt for triangular prisms with an edge length of 180 nm to 250 nm. The depletant can be a surfactant, a stabilizing agent, and/or polyethylene glycol.

Circular disks can be used as seeds for the growth of hexagonal or triangular prisms under conditions similar to those described above. Shape can be controlled based upon relative ratios of the nanoparticle seeds, the reducing agent, the gold salt, and halide salt. Specific description is provided in the Examples.

To further improve nanoparticle uniformity, the nanoparticles can be centrifuged, the supernatant removed, the particles resuspended in a stabilizing agent, and oxidative dissolution is performed again to transform the nanoparticles to a circular disk shape. These nanoparticles can then be regrown into hexagonal or triangular prisms, according to the above conditions. This process of dissolution and growth can be repeated in an iterative manner to sequentially improve nanoparticle size uniformity.

Circular Disks Nanoparticle Seeds

The plasmonic properties of noble metal nanoparticles have been used extensively in a variety of fields, including molecular diagnostics,[1-3] metamaterials,[4,5] surface-enhanced spectroscopies,[6,7] light harvesting,[8,9] and light focusing/manipulation.[10] Anisotropic structures exhibit richer plasmonic properties than spherical structures,[11,12] and with the advent of new synthetic methods, a wide variety of shapes and sizes are available.[13-16] Colloidal anisotropic nanoparticle syntheses are very attractive since they: (1) are scalable and lead to crystallographically well-defined particles in high yield (in contrast to lithographically defined structures)[13,1,18] (2) provide particles with higher absorption and scattering cross-sections than isotropic structures composed of a similar number of atoms,[19,20] and (3) allow one to tailor the spectral position of the LSPR throughout the visible and near-infrared based upon control of particle aspect ratio.[11,21] With these methods, one can access three classes of particles with broadly tunable plasmonic characteristics: one-dimensional (e.g. rods, wires),[21-25] two-dimensional (e.g. triangular prisms, circular disks),[20,26-28] and three-dimensional particles that contain a central dielectric-filled cavity (e.g. cages, core-shell structures).[15,29-31] While methods exist for preparing uniform gold nanostructures of the first and third classes of structures, the only methods for making two-dimensional gold particles with tunable aspect ratios, and therefore plasmonic properties, involves triangular prisms. Even under optimal conditions these syntheses do not yield two-dimensional structures that are uniform in comparison to rod and shell syntheses. It should be noted that Liz-Marzan et al. and Zhang et al. have separately reported protocols for the synthesis of triangular prisms with dramatically improved uniformity. However, these structures are about 40 nm and about 15 nm thick, respectively, which significantly limits the range of synthetically achievable nanoparticle aspect ratios and thus confines the tunability of the dipolar plasmon resonance to a narrow window (630 to 750 nm).[32,33] It is therefore not surprising that there has been a considerable bias towards one and three-dimensional structures in both fundamental and applied work in the field of plasmonics.

Provided herein is a new synthetic method for gold circular disks—two-dimensional nanostructures - that meet the requirements of purity, uniformity, narrow spectral breadth, and resonance tunability over a broad range of energies. A non-uniform mixture of triangular, truncated triangular, and hexagonal plates can be etched with an oxidizing agent such as $HAuCl_4$ in a self-limiting, tip-selective reaction that converts each of these products into similarly sized circular disks, resulting in considerable particle homogenization and narrower plasmon resonances. This method is both remarkable and useful as it takes a relatively ill-defined set of starting materials and chemically drives them all in a convergent fashion into a set of particles with a single well-defined shape. Finally, because these particles are thin (about 7.5 nm), possess a two-dimensional shape with high aspect ratio, and are made of gold, they do not support an observable transverse plasmon mode corresponding to oscillations perpendicular to their circular faces. Unique to this class of anisotropic nanoparticle, this feature makes them appear effectively two-dimensional with respect to their plasmonic properties and may be important for studies in which dipole resonances must be dimensionally confined.

The method for synthesizing circular disk nanoparticles begins with purified triangular prisms prepared according to literature methods.[20,34] With such methods, one can prepare prisms with average edge lengths that can be varied from 30 to 250 nm, while maintaining a constant thickness (about 7.5 nm). Although the established prism isolation procedure removes spherical impurities, it does not separate two-dimensional particles with different cross-sectional shapes (e.g. triangular prisms with zero, one, two, and three truncated corners).[34] This variation in particle shape, in addition to size dispersity, significantly decreases the uniformity and, consequently, contributes to an increased spectral breadth of the nanoparticle LSPR in an ensemble measurement.

To transform the non-uniform triangular prism mixture into uniform circular disks, a conproportionation reaction capable of oxidizing surface Au atoms (FIG. 1A) was used. The particular variant of the reaction used here was first introduced by Liz-Marzan and coworkers in the context of gold rods[35] and has since been extended to other nanoparticle systems.[18,36-38] Specifically, oxidative dissolution of the nanoparticle occurs upon addition of a $Au^{3+}$ salt in the presence of CTAB according to the equation:

$$2\ Au^0 + AuCl_4^- + 2\ Cl^- \rightleftharpoons 3\ AuCl_2^-$$

The key premise of this work is that the use of a slow, controlled conproportionation reaction would allow the reaction to proceed selectively at the surface atoms with the lowest metal coordination number in a self-limiting fashion. It is hypothesized that if the reaction occurred selectively at the tips, rather than at the triangular faces, the same crystallographic surface facet would be maintained on the top and bottom faces of the nanoparticle throughout all experiments, while the edge structure would change. To test this hypothesis, TEM and selected area electron diffraction (SAED) were performed on triangular prism mixtures exposed to different concentrations of the oxidizing agent $HAuCl_4$ (FIG. 1). These data confirm that throughout the transition from triangular prisms to circular disks, there is a consistent {1111} facet on all measured particles, while the edge structure changes dramatically from sharp high-energy to dull low-energy features (FIG. 1A-E). In addition, by preparing TEM samples under slow drying conditions, two-dimensional particles can be imaged in an edge-on orientation, allowing for quantification of the thickness before and after the reaction. These data show no statistically significant change in particle thickness over the course of the reaction. These results collectively suggest that oxidative dissolution occurs selectively at the most coordinatively unsaturated features on the nanoparticle without noticeably impacting the remainder of the structure.

Figure 2:
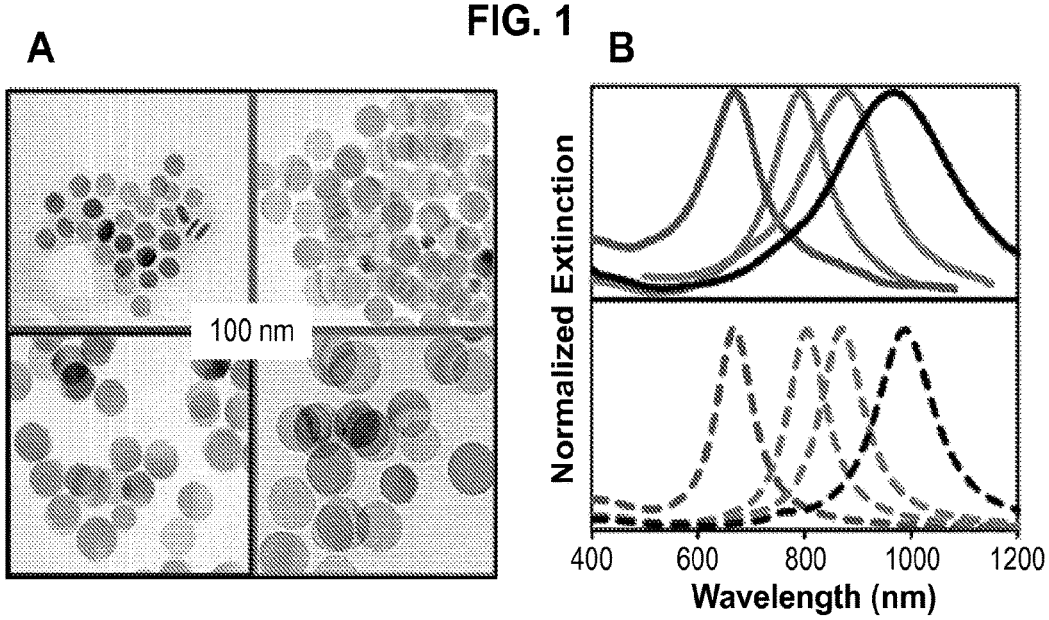
FIG. 2 shows (A) Circular disks with different average diameters (clockwise from top left: 32 nm, 70 nm, 87 nm, and 120 nm). In the top left image, the nanoparticles that appear as rods are circular disks aligned vertically with respect to the TEM grid, as confirmed by a TEM tilt series. (B) Extinction spectra corresponding to the TEM images in A) show tunable LSPR positions from the visible to the near IR. Experimental data is shown on top and DDA simulated data is shown on bottom.
Figure 3:
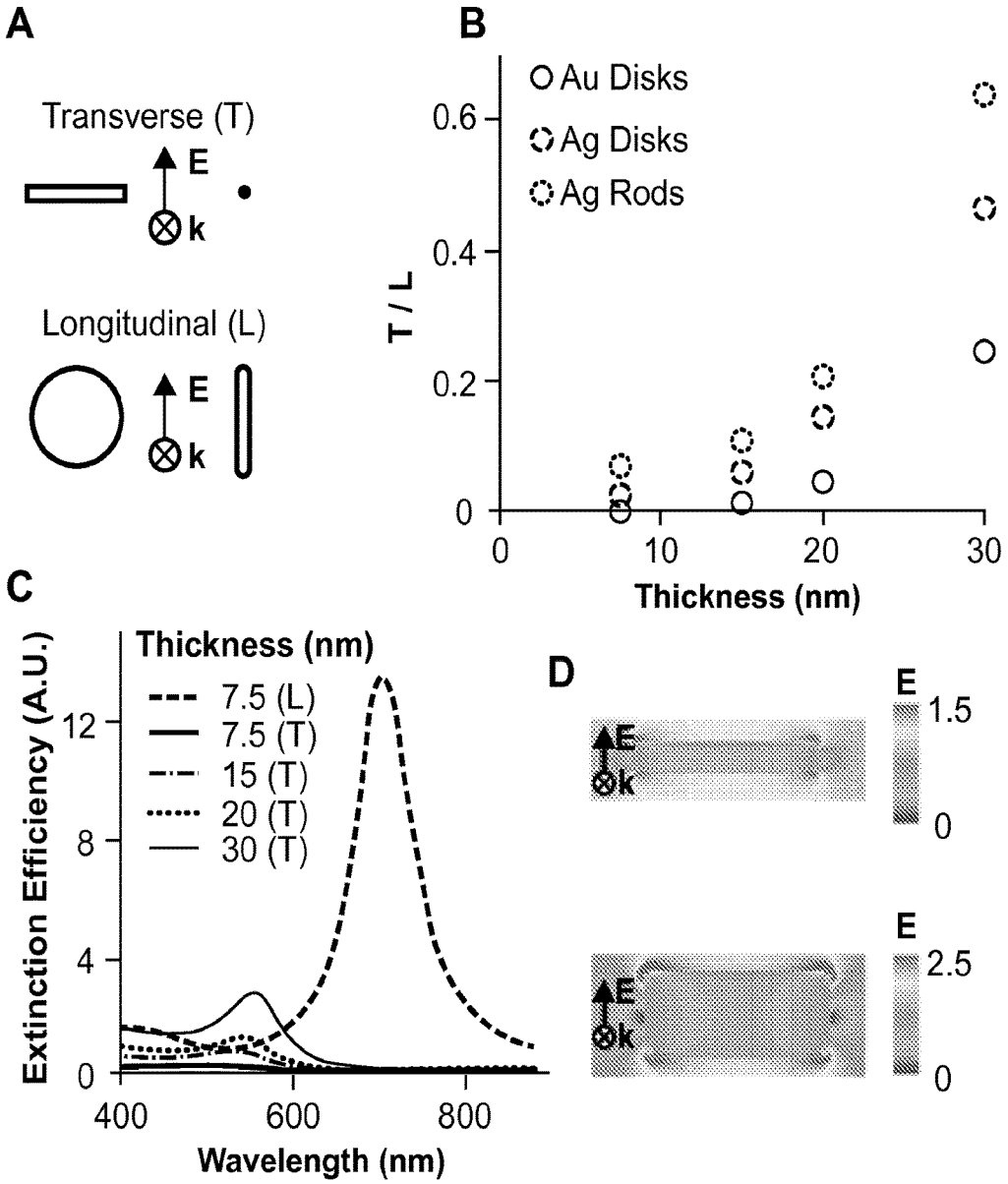
FIG. 3 shows DDA simulations of transverse and longitudinal plasmon modes in circular disk and rod-shaped particles. (A) The longitudinal and transverse plasmon modes can be excited in gold disks (left) and rods (right) depending on the electric field polarization (E) and the wave vector (k) of the incident light. (B) The extinction ratio between the transverse and longitudinal modes (T/L) is plotted versus particle thickness for gold and silver disks with D=46.5 nm (middle and bottom circles, respectively) and for gold rods with a length=46.5 nm (top circles). (C) Simulated extinction spectra of 46.5 nm diameter disks polarized in the transverse orientation with a range of thicknesses (listed in the legend). Only the longitudinal mode (L) for the synthetically achievable 7.5 nm thick disk is shown for comparison. Electric field plots of the transverse mode are shown for: (D) 7.5 nm thick gold disks and (E) 20 nm thick gold disks.

The primary consequence of this approach is that each of the truncation products of the triangular prism synthesis (consisting of zero, one, two, and three corners truncated) are etched to circular disks of approximately the same size, resulting in uniform samples of circular disks (FIG. 1). Importantly, this conproportionation reaction proceeds similarly for a wide range of triangular prism sizes, and thus the diameter of the circular disk can be tuned through the use of differently sized triangular prism precursors (Table 1, FIG. 2). This allows for the synthesis of circular disks with diameters ranging from 30 to 125 nm and LSPRs ranging from 650 to 1000 nm. Interestingly, the diameters of the circular disks in Table 1 are approximately half of the edge length of the initial triangular prisms. This observation is what one would expect if the synthesized disk were inscribed within the original triangular prism and thus supports the claims that the conproportionation reaction proceeds in a self-limiting fashion.

To characterize the variation in nanoparticle dimensions at each stage in this process, and thus quantify to what extent the conproportionation reaction improves nanoparticle uniformity, the area and perimeter of a statistically significant number of nanoparticles were measured from TEM images. Then, an average edge length or diameter was determined for triangular prisms and circular disks, respectively, from both the area and perimeter measurements, and determined a coefficient of variation (CV) for each measurement. This method provides a less biased and more reproducible accounting of nanoparticle dimensions than a single measurement of edge length per nanoparticle and allows us to capture the variation in both size and cross-sectional shape. Applying this analysis to the precursor and product nanoparticles for a range of sizes shows that the uniformity of the nanoparticles improves significantly from triangular prism to circular disk, with a final dispersity in disk diameter of less than 10% for multiple different sizes (Table 1). This improvement in uniformity is in stark contrast to analogous systems that utilized a fast conproportionation rate,[36] and thus emphasizes the importance of the self-limiting, tip-selective approach used here. More broadly, the CVs for the circular disk nanoparticles reported here are comparable to those for the one- and three-dimensional structures discussed above.

In many cases it is also important to know and compare the spectral bandwidth of the LSPR between different nanoparticles, as this metric is closely tied to the strength and lifetime of a plasmon oscillation.[39,40] Spectral broadening in an ensemble measurement can come from properties inherent to the material (such as the nanoparticle composition, shape, and size),[12,41,42] as well as sample uniformity—both of which limit the utility of a collection of particles. To assess spectral bandwidth the in-plane dipole plasmon resonance from UV-Vis measurements of circular disk nanoparticles was fit to a Lorentzian function to determine the FWHM. Importantly, when compared with triangular prism nanoparticles with a similar LSPR, the FWHM of the circular disk is >40% smaller (0.23 eV at 799 nm for disks versus 0.39 eV at 780 nm for triangular prisms), and is comparable to the most uniform rods reported to date from Murray and coworkers (0.23 eV at 799 nm for disks versus 0.23 eV at ~750 nm for rods).[24] The significant improvement observed from triangular prism to circular disk can be attributed to several mechanisms: (1) The circular disk samples are more structurally uniform, as discussed above; (2) The triangular prism particle can support two distinct in-plane dipolar modes (one corresponding to tip-to-tip oscillations and the other corresponding to oscillations from the center of one edge to the opposite tip), while the circular disk can only support one in-plane dipolar mode due to higher symmetry. This increased degeneracy of the in-plane plasmon modes in the circular disks allows more of the excitation energy to be pumped into a single mode, which results in a stronger oscillator strength and a narrower linewidth; and (3) The presence of sharp tips on the triangular prisms is responsible for considerable radiative damping, which is mitigated significantly when they are etched to produce circular disks.[12,41] The narrow FWHM observed here thus indicates both the quality of the circular disk nanoparticles and points towards their potential utility in plasmonics.

TABLE 1

| Triangular Prisms | | | | Reaction Conditions | | Circular Disks | | | |
|---|---|---|---|---|---|---|---|---|---|
| | | Edge | | TP | | | | | |
| LSPR (nm) | FWHM (eV) | Length (nm) | CV (%) | Conc. (pM) | [$HAuCl_4$] (μM) | LSPR (nm) | FWHM (eV) | Diameter (nm) | CV (%) |
| 839 | 0.48 | 65 | 10 | 23 | 8 | 665 (668) | 0.28 (0.27) | 33 | 10 |
| 1020 | 0.34 | 100 | 16 | 15 | 12 | 709 (710) | 0.24 (0.24) | 48 | 6.5 |
| 1154 | 0.28 | 139 | 11 | 10 | 14 | 799 (803) | 0.23 (0.21) | 73 | 9.3 |
| 1220 | — | 170 | 14 | 6 | 12 | 877 (868) | 0.23 (0.20) | 90 | 12 |
| 1296 | — | 197 | 13 | 5 | 12 | 968 (986) | 0.29 (0.21) | 120 | 12 |

Specific technical descriptions for the circular disk seeds are given below. For each reaction, the volumes can be scaled with no change in reaction conditions.

In summary, this methodology provides access to a structurally uniform and tailorable class of two-dimensional circular disk nanostructures with spectrally narrow and broadly tunable plasmon resonances. The approach used here, based upon differences in chemical reactivity of surface atoms on different facets of anisotropic nanostructures, could likely be extended to other shapes and compositions as a generalizable method for improving colloidal uniformity. Beyond expanding the toolkit of well-defined nanoparticles available to researchers, access to these structures will be beneficial to a variety of plasmonic investigations that would otherwise be extremely challenging using the conventional anisotropic nanoparticles available to the field. In particular, the "effectively two-dimensional" nature of the plasmon mode in this structure might provide access to unusual types of plasmon coupling that would be difficult to replicate with other structures. One can also envision using these building blocks in the assembly of one-, two-, and three-dimensional optically active materials,[34,48-51] as the well-defined surface chemistry of gold allows these nanoparticles to be functionalized with a wide array of surface ligands,[52-56] and the two-dimensional shape allows access to assemblies with unique symmetries.[51,54,57] Such materials may be useful for studies of fundamental coupling phenomena, the engineering of Fano resonances, and the design of chiral optical metamaterials.

Spherical Nanoparticle Seeds

Provided herein are methods of preparing spherical nanoparticle seeds under aqueous conditions, and are performed in the absence of organic solvents such as ethylene glycol, dimethylformamide, diethylene glycol, dimethylsulfoxide, toluene, tetrahydrofuran, hexane, octane, and oleic acid, to provide spherical nanoparticle seeds in a yield of at least 90% and having a size of less than 100 nm. The methods comprise (a) admixing gold nanorods, a stabilizing agent, and an oxidizing agent in an aqueous solution to form a first intermediate; (b) admixing the first intermediate, a gold salt, and a reducing agent, and optionally a base and halide salt, in an aqueous solution to form a second intermediate; (c) admixing the second intermediate, a stabilizing agent, and an oxidizing agent in an aqueous solution to form the gold spherical nanoparticle seeds; and (d) optionally repeating steps (b) and (c) at least once to increase the uniformity of the resulting gold spherical nanoparticle seeds, as measured by a coefficient of variation (CV). Additional growth and dissolution steps can be performed to increase the uniformity of the resulting spherical nanoparticle seeds, for example one, two, three, or four additional times.

In some cases, the stabilizing agent is one or more of CTAB, CTAC and CPC.

In some cases, the oxidizing agent is $HAuCl_4$.

The resulting spherical seeds are uniform, as measured by the variation in their size, characterized by a coefficient of variation (CV). The CV of the resulting seeds can 5% or less, or 3% or less. Increased repetitions of the growth and dissolution steps can increase the uniformity (e.g., decrease the CV %).

The growth and/or dissolution can be performed at a temperature of about 20° C. to 50° C. In some cases, the temperature of the dissolution is about 40° C.

The dissolution and/or growth can be performed at a pH of about 3 to 10. In some cases, the pH is adjusted by the addition of a base, such as sodium hydroxide. In some cases, the pH is adjusted by the addition of hydrochloric acid (HCl).

The growth and/or dissolution steps are performed for a time sufficient to result in the desired product (e.g., intermediate or spherical nanoparticle seed). In some cases, the steps are performed for a time of 0.5 hr to 6 hr, or 0.5 hr to 3 hr, or 2 hr or less.

The spherical nanoparticle seeds can be used to prepare a number of other classes of nanoparticle shapes, including cubes, concave rhombic dodecahedra, octahedra, tetrahexahedra, truncated ditetragonal prisms, cuboctahedra, concave cubes, and rhombic dodecahedra, the conditions of their preparation described in detail below.

The ability to predict and control the final products of any chemical reaction is limited by the uniformity of the starting materials. This guiding principle is deeply engrained in molecular chemistry where structurally well-defined and analytically pure reagents have enabled the wealth of knowledge and synthetic capabilities that chemists, biologists, and materials scientists now enjoy. In contrast, chemistry involving nano-particles as reactants, or seeds, for the heterogeneous nucleation of noble metal anisotropic nanoparticle products often does not rely on this tenet due to the difficulty in accessing structurally well-defined particle precursors. Instead, most researchers focus on how to transform an ill-defined initial state into a well-defined end state through manipulation of reaction conditions.(refs 1-4) While this focus on reaction conditions (e.g., reaction rate, the presence of trace metals, ligand affinity) has enabled predictable control of nanoparticle shape, the yield and uniformity of each shape are often not well controlled or understood. Drawing inspiration from molecular chemistry, it is hypothesized that a renewed attention to the structural uniformity of the seed precursors could be used to control the yield and uniformity of anisotropic nanoparticle products. However, the inability to prepare a uniform starting point consisting of seeds with a single size, shape, and crystalline defect structure, and to deliberately change seed uniformity and type, (refs 5-9) has precluded rigorous mechanistic studies correlating seed structure with product structure and generalizable methods that consistently produce uniform nanoparticles. Provided herein are methods that show how iterative reductive growth and subsequent oxidative dissolution can be used for the stepwise refinement of gold nanoparticle seeds used for anisotropic particle synthesis FIG.22 This novel capability allows one to systematically study how size dispersity, shape variation, and crystalline structure of the seed influence anisotropic nanoparticle products and enables the synthesis of numerous classes of single crystalline nanostructures from the same batch of seeds, each consisting of a different shape, where the shape and size uniformity exceeds that of all previously reported syntheses. While oxidative dissolution has been used to alter nanoparticle shape through preferential removal of coordinatively unsaturated features on anisotropic nanoparticles, (refs 10-14) cyclical approaches are rarely used in nanoparticle syntheses and in the refinement of a given class of nanostructures. An iterative process of reductive growth into anisotropic nanostructures and subsequent preferential oxidative dissolution can be used to refine the size distribution for a batch of nanoparticles to use as more uniform seeds FIG.22 at (a)) .

Figure 4:
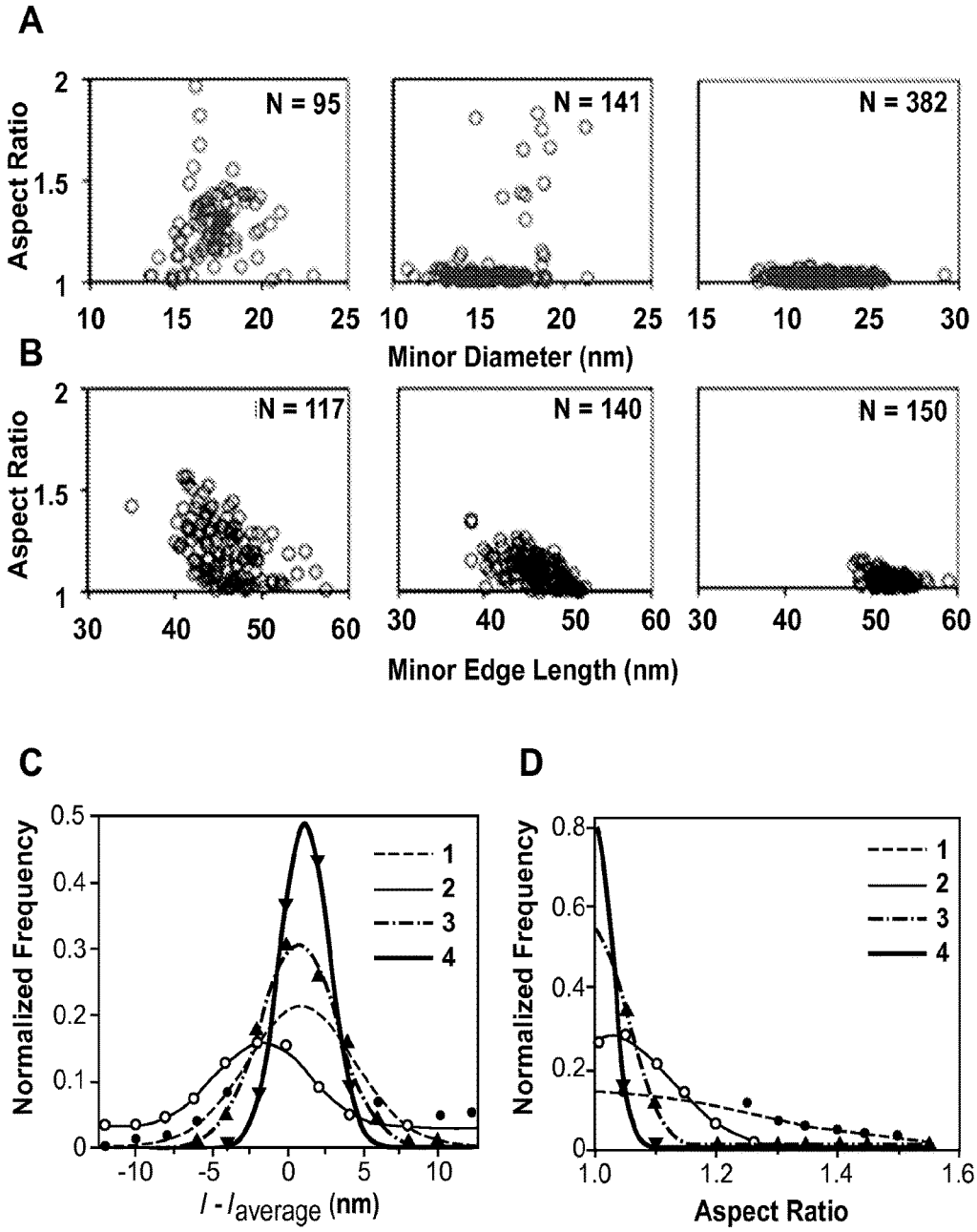
FIG. 4 shows the structural analysis of (a) nanoparticle seeds and (b) cubes grown from these seeds at stages 1, 2, and 3 in the refinement process depicted in FIG. 22 (from left to right, respectively). The number of nanoparticles measured is displayed in the top right of each panel. Frequency plots of (c) the deviation of measured edge length (l) from the average edge length of each sample ($l_{average}$) and (d) aspect ratio are plotted for cubes from four subsequent rounds of refinement.
Figure 5:
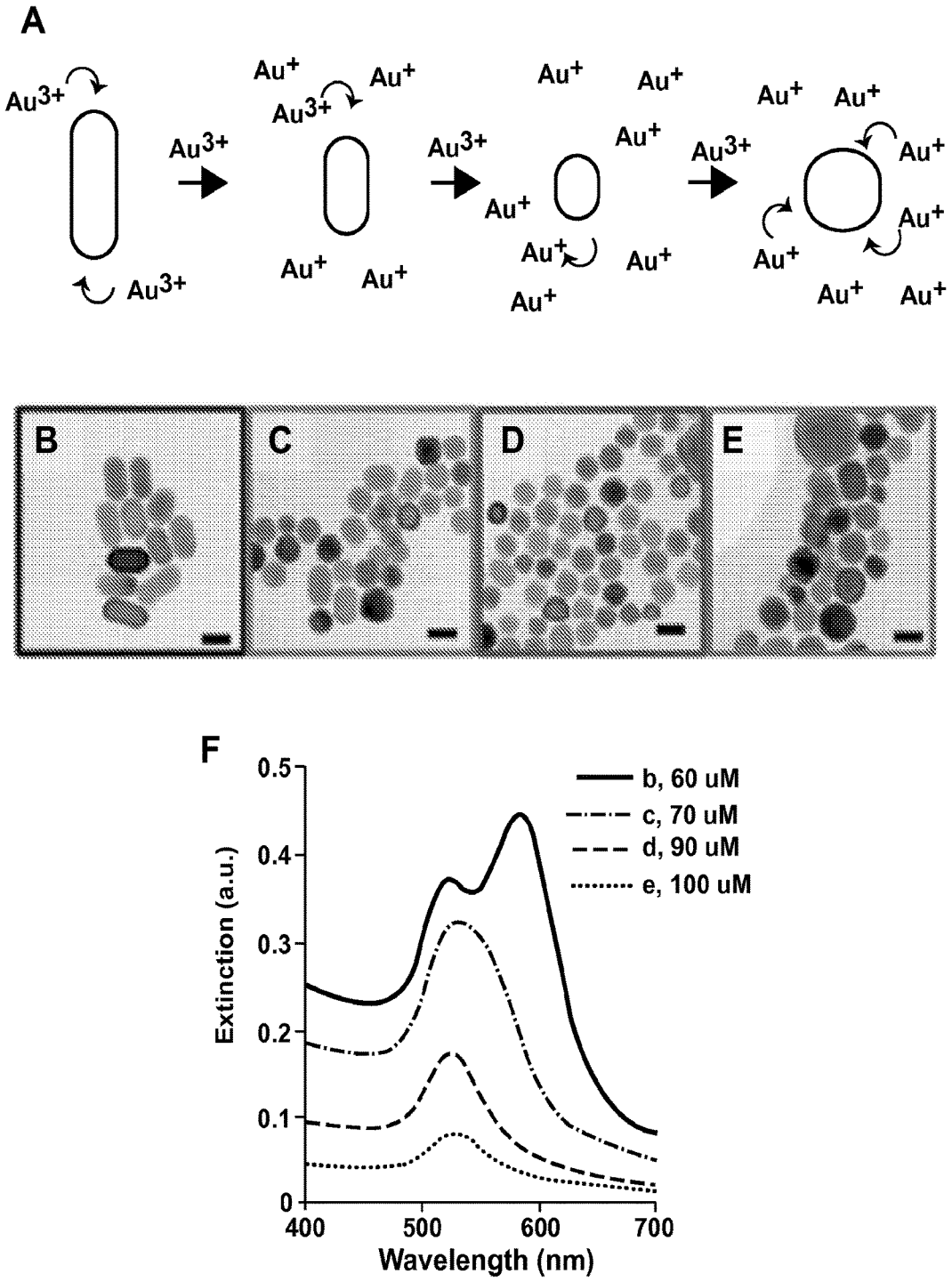
FIG. 5 shows an example experiment to optimize of nanorod oxidative dissolution by varying the $HAuCl_4$ concentration. (a). Scheme showing the selective dissolution of nanorods with $HAuCl_4$ in the presence of CTAB. For simplicity, the oxidizing agent is represented as $Au^{3+}$ to emphasize the redox chemistry occurring in this process. For every $Au^{3+}$ that is reduced to $Au^{3+}$, two gold atoms associated with the nanoparticle are oxidized to $Au^{+}$. (b)-(e). Representative TEM images of nanorods brought to 60, 70, 90, and 100 μM $HAuCl_4$, respectively. Scale bars are 20 nm. (f). Corresponding extinction spectra to the TEM images shown in (b)-(e).
Figure 6:
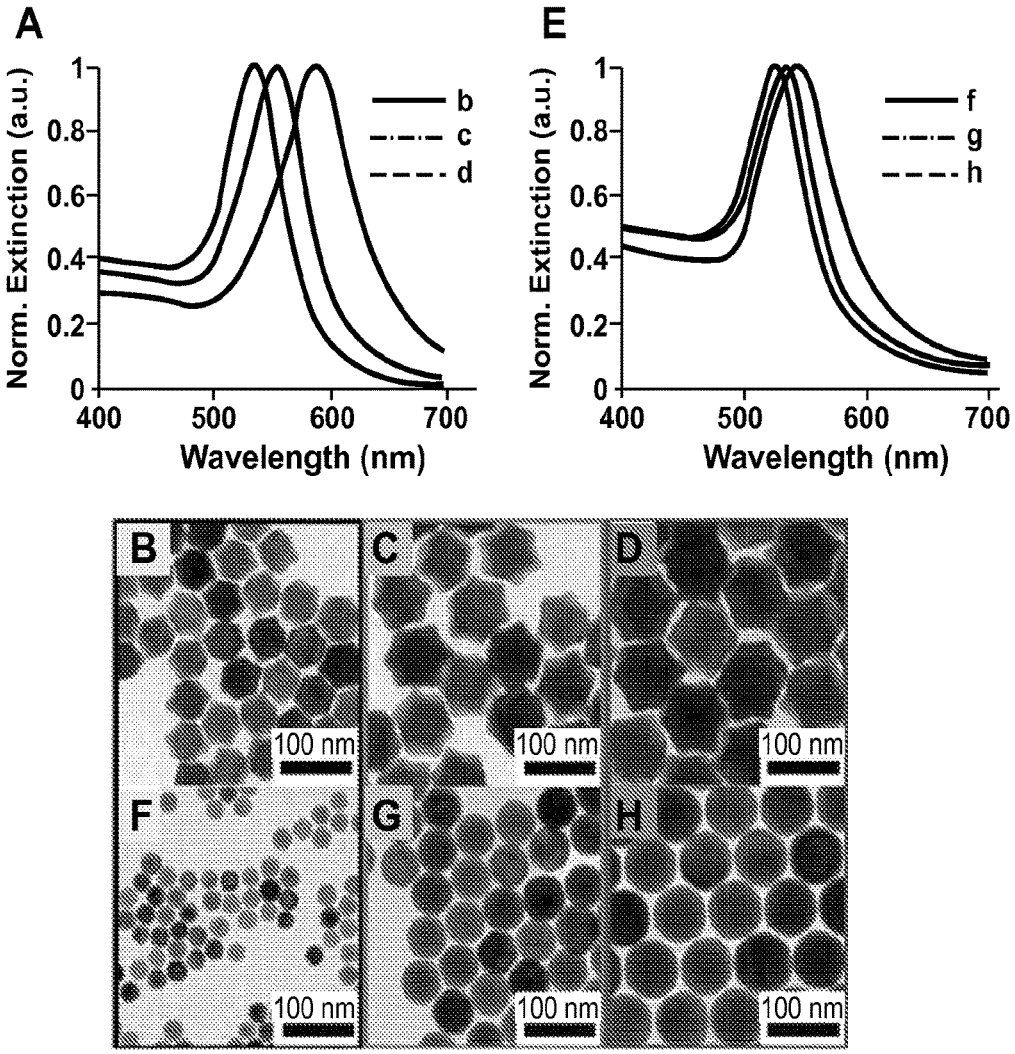
FIG. 6 shows example experiments for how seed size can be controlled by manipulating CRD size and $HAuCl_4$ concentration. (a). CRD extinction spectra corresponding to panels b-d. (b).-(d). TEM images of CRD generated from the same seed solution with varied seed volumes added of 6 mL, 1 mL, and 0.5 mL respectively. (e). Sphere extinction spectra corresponding to panels f-h. (f).-(h). TEM images of spheres generated through CRD dissolution, each set to 1 OD, but exposed to 70 μM, 30 μM, and 15 μM $HAuCl_4$, respectively.

In order to study this, seeds from single crystalline gold nanorods, grown via the method pioneered by El-Sayed (ref 15,16) were prepared. These structures were chosen because they can be made in greater than 95% yield, which ensures a consistent crystalline structure in the seeds throughout the refinement process. (ref. 12) When nanorods are exposed to $HAuCl_4$ in the presence of cetyltrimethylammonium bromide (CTAB), nanorod dissolution proceeds via a conproportionation reaction and occurs preferentially at the more coordinatively unsaturated features at the tips of the rod until a sphere-like geometry is observed, as first reported by Liz-Marzan and co-workers (FIG. 5*a-d*). (ref 10) However, after this etching process, the spherical seeds are still disperse in size, with some residual aspect ratio (FIG. 4*a*). Therefore, a reductive growth step was employed to grow seeds into symmetric, highly faceted concave rhombic dodecahedra. During this process, the size distribution further narrows, which can be attributed to the dependence of growth rate on the size, radius of curvature, and degree of coordination of the surface atoms of the seed. Reductive growth was followed by a second round of oxidative dissolution, where high-energy sites were again preferentially oxidized FIG. 22 at (b); FIG. 4*a*) and residual aspect ratio was further removed (FIG. 6). Importantly, this two-step refinement process can be repeated again to further improve the uniformity of the seeds (FIG. 4*c*).

Figure 22:
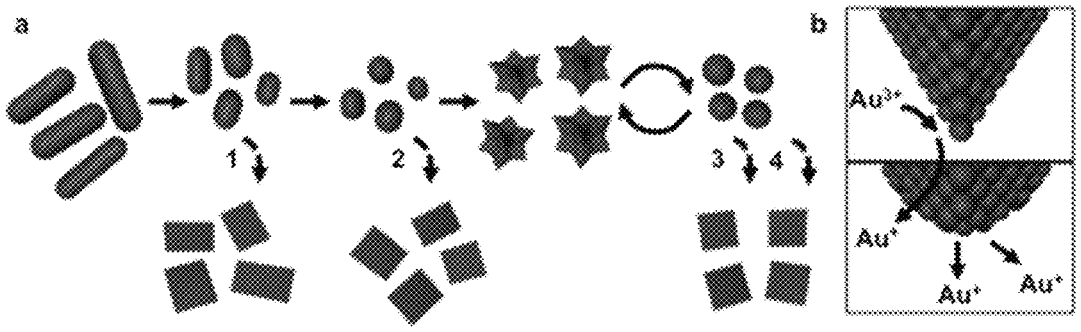
FIG. 22 shows (a) an iterative and cyclical method of reductive growth and oxidative dissolution used to refine nanorods to use as seeds for the synthesis of anisotropic nanoparticle products of various shapes; and (b) the controlled oxidative dissolution of an anisotropic nanoparticle with a $Au^{3+}$ species which occurs preferentially at coordinatively unsaturated atoms, wherein two Au atoms are liberated for every $Au^{3+}$ .

FIG. 22 at (a) shows an iterative and cyclical method of reductive growth and oxidative dissolution used to refine nanorods to use as seeds for the synthesis of anisotropic nanoparticle products of various shapes. FIG. 22 at (b) shows the controlled oxidative dissolution of an anisotropic nanoparticle with a $Au^{3+}$ species which occurs preferentially at coordinatively unsaturated atoms, wherein two Au atoms are liberated for every $Au^{3+}$. Single crystalline gold nanorods were transformed through oxidative dissolution into pseudo-spherical seeds, reductive growth into concave rhombic dodecahedra, and subsequent oxidative dissolution into spherical seeds. The latter two steps were repeated in a cyclical fashion. Numbers indicate steps where nanoparticles were used as seeds to template the growth of cubes. 4 represents an additional round of the cyclic refinement.

Figure 7:
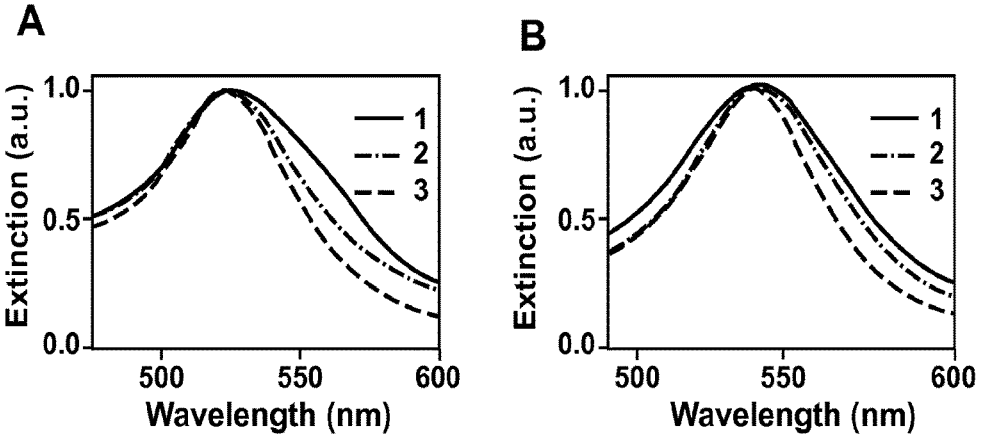
FIG. 7 shows UV-Vis analysis of (a) seeds and (b) cubes grown from those seeds with each round of reductive growth and oxidative dissolution. The number inset corresponds with FIG. 22.

The particles obtained at each step in the refinement process described above can be used to systematically investigate the relationship between seed structural uniformity and anisotropic nanoparticle uniformity in seed-mediated syntheses FIG. 22 at (a); FIG. 4*a-d*). While this relationship is generally appreciated for the synthesis of core-shell nanoparticles, (refs 17-19) where the relationship between seed and product can be correlated simultaneously, it is more difficult to determine the fate of the seed for single composition aqueous seed-mediated syntheses. The uniformity of a nanoparticle synthesis can be defined by how much a collection of nanostructures deviates from an idealized geometric solid in three important ways: yield, shape, and size. In brief, yield provides information about the selectivity of the synthesis for a particular shape (and is intimately related to the crystalline structure of the seed), while aspect ratio (AR) and coefficient of variation (CV) describe the size and shape uniformity within that given shape, which derive from the physical dimensions of the seed. Cubes were studied in depth herein, as they dry in one orientation ({100}-facets parallel to the surface) with no particle overlap. This is a property that enables an automated and standardized measurement of two dimensions per nanoparticle in a high-throughput fashion. Analysis of these data revealed that as the size dispersity of the seeds decreased with each step in the refinement process from 21.5% to 15.7% to 7.3% to 4.9% (FIG. 4*a*), cubes grown from each set of seeds exhibit the same trend, going from 13.2% to 9.3% to 4.8% to 2.8% (FIG. 4*b,c*), all with yields of >95%. Additional analysis of cube aspect ratio suggests that this improvement in size uniformity extends from both a tightening of absolute dimensions, as well as a narrowing in the distribution of aspect ratios, rather than just a shift in aspect ratio, which remains centered at 1 for all samples (FIG. 4*d*). These trends demonstrate a strong correlation between the uniformity of the seed and the uniformity of the nanoparticle and enable the most uniform synthesis of cubes reported to date. (refs 12,20-24) The change in particle quality can be corroborated through an ensemble measurement of the full width at half-maximum (fwhm) of the localized surface plasmon resonance (LSPR), where inhomogeneities manifest as peak broadening (FIG. 7). (refs 25,26) Indeed, these data show the fwhm of the seed and cube LSPRs decrease with each refinement step (from 90 to 72 to 60 to 58 nm for seeds and from 86 to 66 to 56 to 55 nm for cubes).

Figure 8:
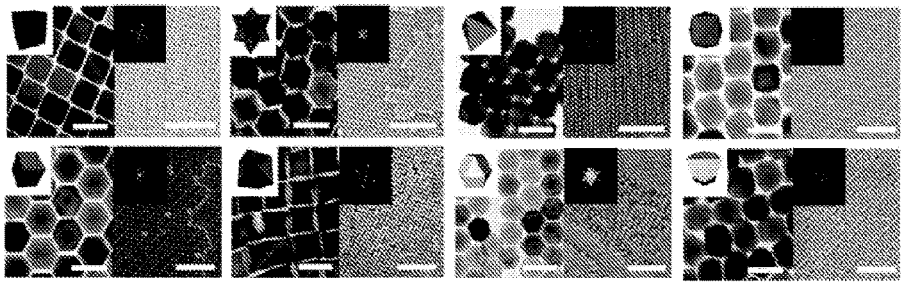
FIG. 8 shows high quality seeds can be used interchangeably to generate eight different shapes. Each panel represents a different shape synthesized from seeds at stage 3 in FIG. 22. and is arranged counterclockwise from top left as three-dimensional graphic rendering of the shape; TEM image (scale bars are 100 nm); high-magnification SEM image of crystallized nanoparticles (scale bars are 500 nm) with FFT pattern inset. Moving clockwise from the top left, the shapes described are cubes, concave rhombic dodecahedra, octahedra, tetrahexahedra, truncated ditetragonal prisms, cuboctahedra, concave cubes, and rhombic dodecahedra. This demonstrates how uniform nanostructures generated via this method can be assembled into arrays with long-range order, where the nanoparticle shape dictates the crystal symmetry and shape.

The shape, size, and crystalline structure of the seeds should dictate the uniformity and shape yield of anisotropic nanoparticle products. This simple idea suggests that highly uniform nanoparticle seeds can be used interchangeably in a variety of syntheses as a universal precursor. If true, this would eliminate the need for unique seed synthesis protocols as currently exists in the literature and facilitate a systematic approach to investigation of nanoparticle shape-based phenomena. To confirm this, one set of seeds was used to template the growth of eight unique shapes: cubes, tetrahexahedra, (ref 27) concave cubes, (ref 28) octahedra, cuboctahedra, rhombic dodecahedra, (ref 29) concave rhombic dodecahedra, and truncated ditetragonal prisms (refs 22,30) (FIG. 8). Importantly, all follow the relationship established above between seed quality and nanoparticle quality and are obtained in greater yield (>95%) with better uniformity than existing reports over a wide range of sizes. The range of shapes generated spans multiple exposed crystal facets ({111}, {110}, {100}, {310}, {520},{720}), a range of degrees of anisotropy, and includes both concave and convex polyhedra. This property of interchangeability represents the greatest number of shapes generated from a single set of seeds and suggests that the wealth of literature on shape control in seed-mediated nanoparticle synthesis could be repeated with a renewed focus on seed uniformity to receive markedly better results.

Many fundamental physical and chemical properties of anisotropic nanoparticles have not been experimentally measured due to the lack of sufficiently uniform solutions to correlate bulk behavior with that of individual nanoparticles. One important example of this is an optical extinction coefficient, a property that is influenced by nanoparticle size, shape, and composition and enables one to determine the number of species in a solution with a simple bulk spectroscopic measurement. However, for all gold anisotropic nanoparticle shapes except triangular prisms (ref 31) and rods, (refs 32-34) extinction coefficients have not been determined. To probe the effect of size dispersity on the observed extinction coefficient, several solutions of cubes were systematically prepared with the same average edge length but varied dispersity though the above refinement procedure. It was found that the extinction coefficients measured for these samples monotonically increases by 40% as the CV decreases from 14.4% to 2.8% (FIGS. 10-11; Table 3), showing the importance of size and shape dispersity in determining bulk optical properties. As a result, extinction coefficients have been measured for eight shapes produced from refined seeds, all as a function of size (Table 2). These values enhance the ability to understand trends in optical properties as a function of size, shape, and degree of anisotropy, and simultaneously facilitate the use of these anisotropic nanoparticles.

TABLE 2

Average Edge Lengths (l), Dispersity in Edge Length Measured by the Coefficient of Variation (CV), Localized Surface Plasmon Resonance (LSPR), and Extinction Coefficients at the LSPR for Several Sizes of Each Shape Investigated[a]

| Shape | 1 (nm) | CV (%) | LSPR (nm) | Extinction coefficient ($M^{-1}$ $cm^{-1}$) |
|---|---|---|---|---|
| Cube | 43 | 4.1 | 538 | $4.51 \pm 0.02 \times 10^{10}$ |
| | 62 | 4.0 | 565 | $1.40 \pm 0.01 \times 10^{11}$ |
| | 74 | 4.7 | 589 | $2.17 \pm 0.01 \times 10^{11}$ |
| | 87 | 4.5 | 602 | $2.86 \pm 0.01 \times 10^{11}$ |
| Rhombic dodecahedron | 39 | 3.9 | 556 | $8.99 \pm 0.02 \times 10^{10}$ |
| | 49 | 2.4 | 568 | $1.60 \pm 0.01 \times 10^{11}$ |
| | 54 | 3.2 | 580 | $1.87 \pm 0.01 \times 10^{11}$ |

TABLE 2-continued

Average Edge Lengths (l), Dispersity in Edge Length Measured by the Coefficient of Variation (CV), Localized Surface Plasmon Resonance (LSPR), and Extinction Coefficients at the LSPR for Several Sizes of Each Shape Investigated[a]

| Shape | 1 (nm) | CV (%) | LSPR (nm) | Extinction coefficient ($M^{-1}$ $cm^{-1}$) |
|---|---|---|---|---|
| Truncated ditetragonal prism | 58 | 5.4 | 554 | $8.96 \pm 0.03 \times 10^{10}$ |
| | 76 | 4.2 | 567 | $1.64 \pm 0.01 \times 10^{11}$ |
| | 99 | 4.6 | 583 | $3.17 \pm 0.01 \times 10^{11}$ |
| Cuboctahedron | 40 | 3.8 | 531 | $2.26 \pm 0.07 \times 10^{10}$ |
| | 67 | 3.3 | 553 | $1.19 \pm 0.01 \times 10^{11}$ |
| Concave cube | 43 | 5.6 | 576 | $6.40 \pm 0.01 \times 10^{10}$ |
| | 63 | 6.6 | 612 | $1.54 \pm 0.01 \times 10^{11}$ |
| | 84 | 5.3 | 648 | $2.62 \pm 0.01 \times 10^{11}$ |
| Tetrahexahedron | 43 | 3.8 | 546 | $6.95 \pm 0.33 \times 10^{10}$ |
| | 62 | 3.0 | 572 | $1.12 \pm 0.02 \times 10^{11}$ |
| | 75 | 4.0 | 588 | $2.17 \pm 0.03 \times 10^{11}$ |
| Octahedron | 62 | 3.7 | 571 | $7.59 \pm 0.01 \times 10^{10}$ |
| | 80 | 2.6 | 591 | $1.43 \pm 0.01 \times 10^{11}$ |
| | 110 | 3.2 | 624 | $2.43 \pm 0.01 \times 10^{11}$ |
| Concave rhombic dodecahedron | 28 | 4.2 | 558 | $3.69 \pm 0.02 \times 10^{10}$ |
| | 39 | 3.7 | 578 | $9.56 \pm 0.08 \times 10^{10}$ |
| | 56 | 2.4 | 608 | $2.50 \pm 0.01 \times 10^{11}$ |

[a]Nanoparticle dimensions were measured from at least 100 nanoparticles for each sample The seed-focused approach to anisotropic nanoparticle synthesis presented here establish a shift in the field of nanoparticle chemistry toward an emphasis on control and characterization of the starting reagents in order to achieve high quality products. Such an approach likely can be extended to other crystal defect structures (e.g., planar-twinned and penta-twinned seeds) and compositions to not only improve the uniformity of existing nanostructures but also to realize novel morphologies. Furthermore, the systematic approach used to vary particle shape and dispersity make this approach an ideal platform to investigate how nanoparticle uniformity and morphology impact properties and performance in a wide range of applications beyond the extinction coefficient measurements explored here.

EXAMPLES

Gold Nanorod Synthesis: Gold nanorods were synthesized using a modified version of the silver-assisted protocol reported in Nikoobakht et al., *Chem Mater.* 2003 15:1957. Briefly, 125 μL of 10 mM $HAuCl_4$ was added to 5 mL of 100 mM cetyltrimethylammonium bromide (CTAB). Ice cold $NaBH_4$ (300 μL at 10 mM) was rapidly injected into the solution and allowed to stir for one minute to initiate seed nucleation. Then, 200 mL of 100 mM CTAB, 10 mL of 10 mM $HAuCl_4$, 1.8 mL of 10 mM AgNO3, 1.14 mL of 100 mM L-ascorbic acid, and 240 μL of seed solution were added in succession and allowed to stir for 1 minute to ensure thorough mixing. The rod solution was then left untouched in a 28° C. water bath for 2 hours. It should be noted that this reaction is highly sensitive to trace halide impurities commonly found in CTAB (see Smith et al., *Langmuir,* 2009 25:9518 and Rodriguez-Fernandez et al., *J Phys Chem B,* 2005 109:14257). Therefore, poor yields can often be solved by changing the source of CTAB or by analytically confirming the purity. These synthetic conditions generate nanorods 50±4 nm in length by 15±2 nm in diameter in about 95% yield (rods versus other shapes formed).

Iterative Oxidative Dissolution and Reductive Growth: The coordinatively unsaturated atoms at high-energy sites of anisotropic nanoparticles (e.g. tips, edges) exhibit enhanced reactivity compared to other surface atoms under controlled oxidative dissolution conditions. For gold nanoparticles, a common approach to achieve controlled dissolution involves the CTAB-mediated conproportionation reaction with $HAuCl_4$ first studied in Rodriguez-Fernandez et al., *J Phys Chem B,* 2005 109:14257 in the context of gold nanorods. In this reaction, $HAuCl_4$ acts as a nanoparticle oxidizing agent, while CTAB acts in part as a complexing agent for $Au^+$ species (associated with oxidized gold liberated from the nanoparticle and the reduced gold used as an oxidizing agent). Therefore, while $HAuCl_4$ concentration is more intuitively important to control the degree of oxidative dissolution, CTAB concentration must also be considered to sequester $Au^+$ species generated through this chemistry and thereby prevent unwanted $Au^+$ nucleation.

When choosing the appropriate nanoparticle precursor for this work, the crystalline defect structure, size, and shape were the primary considerations. Defect structure of the initial particle dictates the defect structure of the final seeds and therefore dictates the defect structure of the final particle under most conditions investigated. Size of the initial particle precursor will dictate the lower limit of the seeds. For example, the size of the seeds after one full round of rod oxidative dissolution was dictated by the diameter of the initial rods. Therefore, a high aspect ratio rods with small diameters was used to achieve small (e.g., <20 nm) seeds. Lastly, the shape, or more specifically the presence or absence of locations with coordinatively unsaturated atoms (related to the presence of high-energy facets and highly anisotropic structures) dictates the driving force for preferential oxidative dissolution.

Briefly, as-synthesized nanorods were first centrifuged two times for 15 minutes at 8,000 rpm to remove excess reagents, each time resuspending the nanorods in 50 mM CTAB. Then, an extinction spectrum was collected to determine nanorod concentration, and the nanorod solution was brought to 2 OD with 50 mM CTAB. This solution was then brought to a final $HAuCl_4$ concentration of 90 μM and allowed to gently stir for 4 hours at 40° C. To terminate the reaction, the solutions were centrifuged two times for 30 min at 11,000 rpm, resuspending the nanoparticles each time in 100 mM cetylpyridinium chloride (CPC). It should be noted that batch-to-batch variations in the nanorod synthesis can affect the optimal concentration of $HAuCl_4$ required for dissolution. To account for this, small 0.5 mL test batches were etched over a range of $HAuCl_4$ concentrations (60-100 μM in 10 μM increments), and the resultant solutions were analyzed by UV-Vis spectroscopy and transmission electron microscopy (TEM). As the gold concentration is increased in this process, the aspect ratio of the nanorods decreases until a sphere-like geometry is observed (FIG. 5*b-d*). This correlates with a shift from two observable localized surface plasmon resonances (LSPRs) in the extinction spectrum to a single LSPR, then as a blue-shift and decrease in the plasmon bandwidth (FIG. 5*f*). The optimal gold concentration is reached just before the plasmon bandwidth begins to increase and the LSPR position begins to red-shift (FIG. 5*d*, 5*f*). After this optimal gold concentration, reduction of liberated gold onto the nanoparticles competes with continued oxidative dissolution and results in a greater size variation (FIG. 5*e*). If large particles are observed as a result of a greater than optimal $HAuCl_4$ concentration, these can be easily removed through a three rounds of low-speed centrifugation (i.e. 4 minutes at 3,000 rpm, where the supernatant contains the desired nanoparticles).

To synthesize concave rhombic dodecahedra (CRD), 20 mL of 10 mM CPC, 350 μL of 10 mM $HAuCl_4$, 4.5 mL of 100 mM ascorbic acid, and 6 mL of seeds (at 1 OD concentration) were mixed in succession and allowed to grow for ~15 minutes. Next, the CRD solution was centrifuged two times for 10 minutes at 10,000 rpm and the CRD resuspended in 50 mM CTAB each time. CRD dissolution was performed at 40° C., in 50 mM CTAB, with a CRD concentration of 1 OD, and a typical final $HAuCl_4$ concentration of 60 μM, with gentle stirring for 4 hours. Small 0.5 mL test batches were also used, as described above, to ensure appropriate dissolution conditions. It should be noted that CRD size can be increased by decreasing the volume of seeds added to the CRD synthesis, and these CRD can be used to produce larger nanoparticle seeds with no loss in quality up to 100 nm (FIG. 6).

The process of reductive growth into CRD and subsequent oxidative dissolution can be repeated in an iterative fashion to sequentially improve seed quality (FIG. 1, 7*a*). However, it should be noted that the majority of the improvement occurs in the first two rounds of dissolution (the nanorod dissolution and the first CRD dissolution), with each subsequent round resulting in only a small improvement in seed quality. Furthermore, as high-energy sites are removed and gold is nucleated onto the nanoparticle with each round, the size of the seed slightly increases, which limits the lower size of the products that can be generated from these seeds.

The Impact of Seed Structural Uniformity on Seed-Mediated Anisotropic Nanoparticle Synthesis: FIG. 7 shows UV-Vis analysis of materials after iterative rounds of reductive growth and oxidative dissolution.

Automated Particle Size Quantification: Measurement of nanoparticle dimensions can be highly subjective depending on the methods of image acquisition and structural analysis used. As a result, reported nanoparticle dispersity values often skew toward higher uniformities than actually present in the sample. In order to minimize the subjectivity associated with our measurements of nanoparticle dimensions, a number of considerations were taken into account. First, electron microscopy samples were prepared from dilute nanoparticle solutions and dried quickly in a vacuum dessicator. This preparation resulted in small areas only several nanoparticles across (rather than extended crystalline sheets) and therefore minimizes size- and shape-sorting effects associated with nanoparticle crystallization (see, e.g., Bishop et al., *Small* 2009 5:1600). Second, images used for structural analysis were captured from at least ten unique regions to capture the full distribution of nanoparticle sizes, rather than localized effects due to crystallization. Each of these images was taken at a sufficient magnification and resolution to allow for <1 nm resolution. Third, in order to accurately determine the relationships between particle quality and properties, an automated method for measuring the size (two dimensions per nanoparticle) of statistical numbers of individual particles was developed. This method reduces bias from manual measurement with image processing software, measurement of only a single dimension per nanoparticle (which often ignores the effect of aspect ratio), and measurement of a statistically insignificant number of nanoparticles.

Additionally, no significant bias towards smaller particles is expected on account of excluding the particles that are off the edge of the image. To estimate the magnitude of this bias, the fraction of the area of a given image in which a particle would have be located in order to be excluded was calculated. For example, considering an image of width L and a spherical particle of radius r, the probability that a particle randomly that is placed with its center in the image will be excluded is: $Pex=4(L-r)r/L^2$, which is equal to the fraction of the area of the image within r of the edge. Taking the example of the case with the most dispersity (first round data from FIG. 1*c*) with <r>=8.5 nm and a CV of 15%, numerical integration shows that this effect would result in an 0.4% shift in the mean and a 0.03% shift in the standard deviation. Thus, while this effect could dominate in cases where the field of view is commensurate with the size of the particles, it is trivial here.

To begin, as-synthesized samples were diluted 20× with water and then centrifuged, allowing the supernatant to be removed. The particles were then resuspended in 20 L of water. A small aliquot of this solution was added to a formvar stabilized with carbon copper TEM grid and allowed to dry in a vacuum dessicator. Subsequently, images were collected with a Hitachi H8100 TEM in dark field mode. Care was taken to ensure that all images for a given particle size were taken at the same magnification. It was important to find drying conditions that resulted in particles that were visibly separated in order to facilitate analysis.

All images were analyzed by a custom MATLAB script designed to identify particles and report their size and aspect ratio. First, an edge detection algorithm was run on each image. Specifically, a Laplacian of Gaussian subroutine implemented in the image processing toolbox of MATLAB was run with a threshold value of zero. Next, closed regions were found and filled in using a subroutine in the MATLAB image processing toolbox. These represent the candidate objects that may be considered particles.

The next task was to determine which candidate object corresponded to a nanoparticle. In order for a candidate object to be treated as a particle for analysis, it must pass a series of criteria: (1) it must be larger than ~30 pixels from edge to edge (this is ~27 nm for cubes and ~10 nm for seeds), (2) it must not be touching an edge of the image, and (3) it must have a solidity value of over 90%, a parameter that means that objects must not have large voids and cannot have large asperities. These conditions exclude common background artifacts and are found to correctly identify >80% of the particles in a given image (verified by visual inspection).

Figure 9:
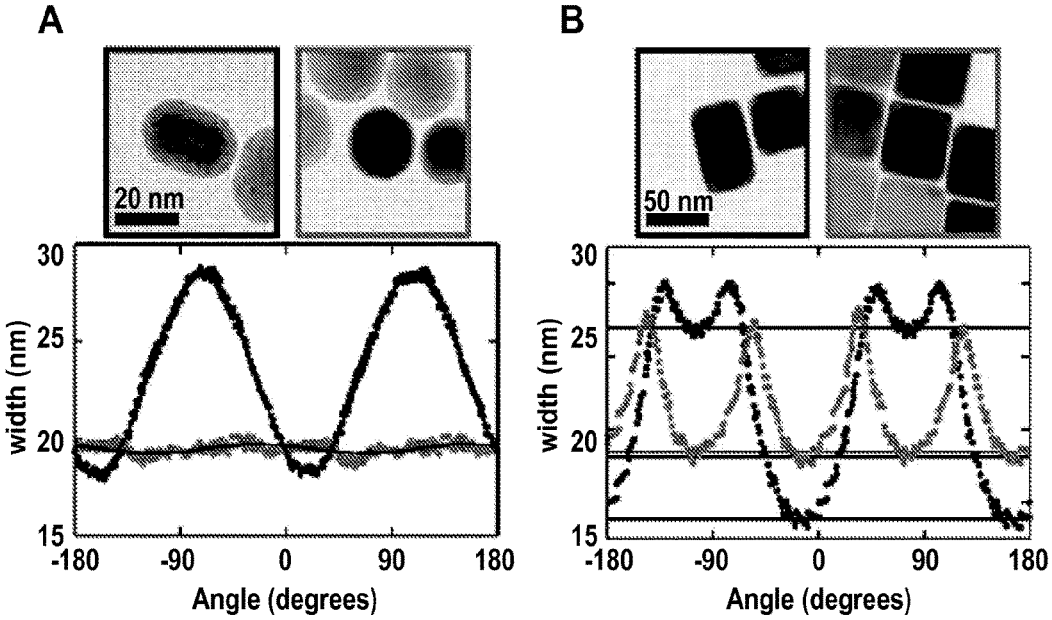
FIG. 9 shows size and shape analysis for individual nanoparticles. (A) Width vs. angle computed for two seed particles, one with a large aspect ratio and one with an aspect ratio of nearly one. The black lines are the sinusoidal fits that were used to quantify the particle size. (B) Width vs. angle computed for two nanocubes, one with a large aspect ratio and one with an aspect ratio of nearly one. The horizontal lines represent the computed values of the major and minor edge lengths for each particle.

Following identification of valid particles, the algorithm computed the shape and size of each object. To begin this process, the centroid of each object is identified. Next, at each point along the perimeter of that object, the width of the object was estimated by reflecting the point through the centroid and finding the point on the opposing side that is the closest to the reflected point. From this calculation, the width is plotted as a function of angle (FIG. 9).

The relationship between width and angle allowed for the quantification of the size and shape of a given object, specifically the value of major and minor axes. For a spherical particle, the curve was fit to a sinusoidal function with a period of 180 degrees and the heights of the peaks and troughs correspond to the major and minor axes, respectively (FIG. 9A). For a particle with a rectangular cross section, the curve consists of four peaks and four troughs with the peaks corresponding to the corners and the troughs corresponding to the edges (FIG. 9B). The heights of the lower two troughs were used to compute the minor edge length and the heights of the higher two troughs are used to compute the major edge length. The process of analyzing a single nanoparticle was repeated for all particles in each image.

Extinction Coefficient Determination: To determine the extinction coefficient of a nanoparticle, one must relate nanoparticle concentration to extinction as measured by UV-Vis spectroscopy at the maximum value of the LSPR. The slope of a linear fit relating these parameters represents the extinction coefficient. To determine nanoparticle concentration, one can relate nanoparticle dimensions measured by TEM with the number of gold atoms in a digested nanoparticle sample, here measured by inductively coupled plasma optical emission spectroscopy (ICP-OES), and the volume of a single gold atom (0.01257 $nm^3$). There are a number of requirements for such an analysis to be valid, as well as a number of assumptions that must be made.

Requirements include: a consistent LSPR position and line shape regardless of nanoparticle dilution, which indicates that particles are freely disperse (no plasmonic coupling effects) and that no change in shape is occurring as the nanoparticles are diluted (often due to insufficient ligand at large dilutions); measurement of a quantitative number of nanoparticle dimensions, such that representative average dimensions are taken into account; at least three dilutions with correlated gold content measurements, such that these values may be fit to a line to determine the extinction coefficient; and multiple replicates of each gold content measurement to minimize error associated with sample measurement.

Assumptions include: TEM measurements of a two-dimensional nanoparticle cross-section are representative of the third dimension; every gold nanoparticle measured by UV-Vis is completely digested; and every digested gold atom is measured by ICP-OES.

To achieve the first requirement, samples had to be centrifuged once, resuspended in the same volume of water, and allowed to sit for >6 hours. This dilution was required to break up the depletion force assembly of cubes that occurs under as-synthesized conditions. To confirm this dilution does not change the shape of the nanoparticles, TEM and UV-Vis analysis were performed. TEM analysis immediately after this dilution, after 6 hours, and after 4 days revealed no noticeable change in corner truncation. UV-Vis analysis showed consistent peak positions and extinction values from 6 hours out to 4 days, which suggests that this dilution does not significantly impact nanoparticle shape.

Figure 10:
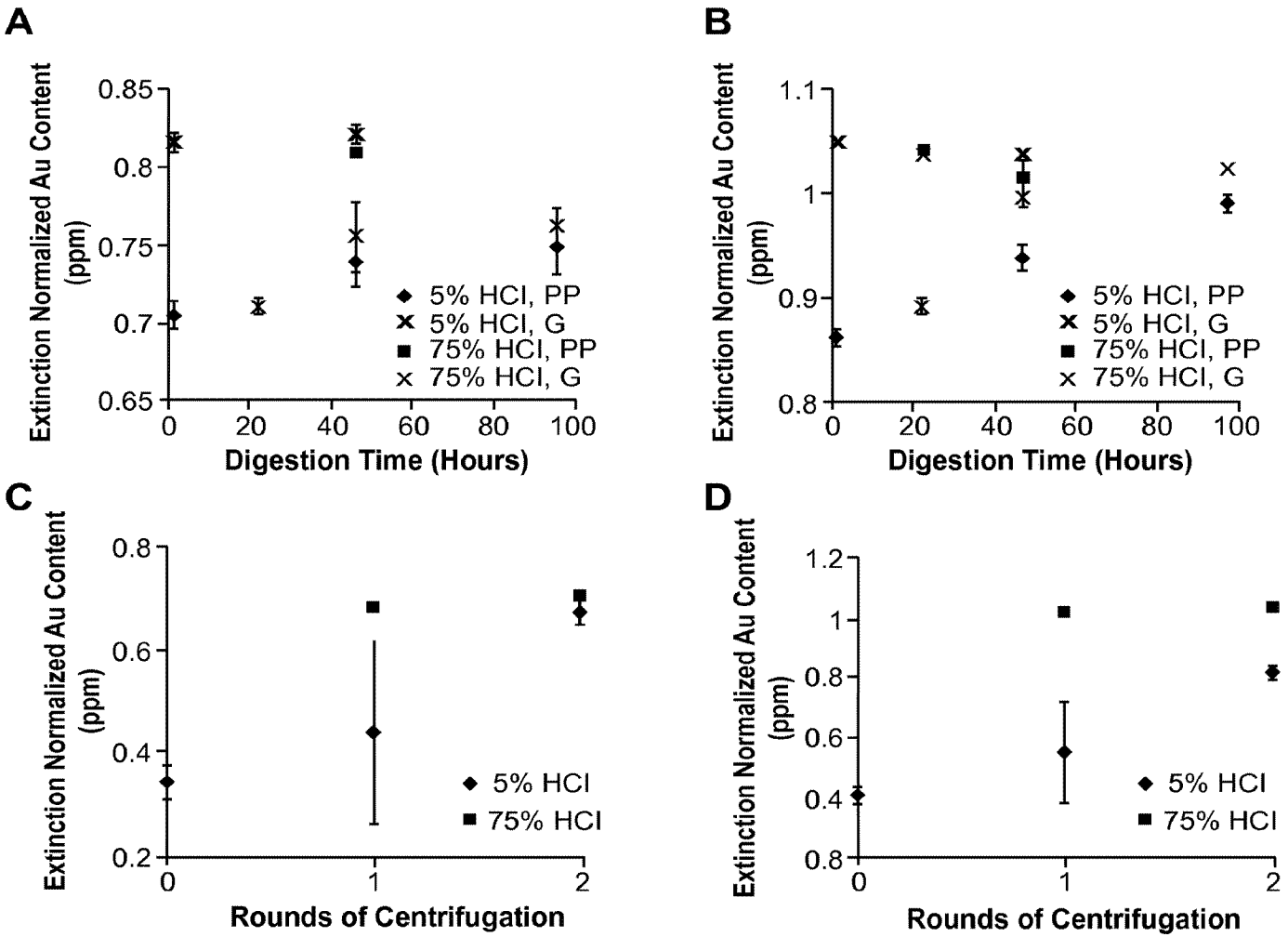
FIG. 10 shows ICP-OES Control Experiments. (a). and (c). are for cubes with a resonance of 556 nm, (b). and (d). are for cubes with a resonance of 585 nm. (a), (b). Gold content normalized to the measured extinction values versus digestion time. Digestion was investigated as a function of % HCl (the remainder is $HNO_3$) and digestion container (G=glass, PP=polypropylene). (c), (d). Gold content normalized to the measured extinction values as a function of the number of rounds of centrifugation to remove excess stabilizing agent. This was investigated for both 5% HCl and 75% HCl acid mixtures.

Similar control experiments were performed for ICP analysis to investigate the effect of etchant composition, digestion container, digestion time, and excess stabilizing agent/number of rounds of centrifugation on measurements of gold content (FIG. 10). ICP control experiments were performed for two cube sizes to ensure the results were translatable across sizes. For all such control experiments, the samples were brought to roughly 0.1 OD in 3.2 mL, and the extinction measured. Then, three one-milliliter aliquots for each sample were taken from this 0.1 OD solution as replicates to account for experimental error in sample preparation. Samples were either used as is, or centrifuged one or two times to remove excess stabilizing agent for 15 minutes at 12,000 rpm. After the final centrifugation step, the supernatant was removed and 70 μL of an acid solution was directly added to the pellet, followed by sonication to completely break up the pellet, and brief centrifugation to concentrate the liquid from the sides of the tube. For the sample used as is, without any centrifugation, the acid was added directly to the 1 mL solution. To investigate the effect of digestion container, these samples were either kept in 1.5 mL polypropylene Eppendorf tubes or immediately transferred to glass vials, and allowed to sit for varying amounts of time (1 hour, 24 hours, 48 hours, and 96 hours). After the designated digestion duration, the volume of each sample was measured, and the sample was brought to 1 mL total volume with water. Then, this solution was brought to 2% total acid by volume and 1 ppm Indium (used as an internal standard to account for instrumental drift) in 3.5 mL total prior to ICP analysis. ICP analysis was performed on a Varian Vista MPX ICP-OES with Au standards prepared between 0 and 10 ppm, with an internal In standard of 1 ppm, and the same concentration of acid (2%) as the samples.

Specifically, it was found that commonly used acid concentrations for nanoparticle digestion (either 2% HCl/98% $HNO_3$ or 5%HCl/95% $HNO_3$) returned gold content values 10-40% lower than samples digested with 75% HCl/25% $HNO_3$ (FIG. 10*a-b*). When digestion with these acid conditions was investigated as a function of time, it was found that the gold content values measured for samples digested with a 5% HCl/95% $HNO_3$ mixture increased with time, suggesting that the discrepancies may be due to dissolution kinetics. However, even after 4 days, digestion with a 5% HCl/95% $HNO_3$ mixture still did not recover the full gold content as measured from samples digested with a 75% HCl/25% $HNO_3$ mixture. In contrast, samples digested with a 75% HCl/25% $HNO_3$ mixture were fully digested within one hour, with no measurable change in gold content over two days. When digestion over time was investigated, both polypropylene Eppendorf tubes and small glass vials were used to investigate the loss of gold to the container, but found minimal difference between containers (FIG. 10 *a-b*). Last, it was found that digestion with the 5% HCl/95% $HNO_3$ mixture was strongly affected by excess stabilizing agent (the number of centrifugation rounds), however the 75% HCl/25% $HNO_3$ mixture was only minimally affected (FIG. 10*c-d*).

As a result of the above control experiments, the procedure for the determination of a nanoparticle extinction coefficient was performed as follows. Briefly, each as-synthesized nanoparticle solution was centrifuged one time to isolate the particles and remove excess stabilizing agent. The nanoparticles were then re-suspended in the same volume of water and allowed to sit >12 hours to ensure all depletion force-related interactions were fully disrupted. Then, six solutions of different nanoparticle concentrations were prepared (3.2 mL each, 0.1 OD-1 OD) and characterized by UV-Vis spectroscopy. Each of these six solutions was then split into three one mL aliquots, as replicates to account for experimental error, and centrifuged an additional two times to further remove excess stabilizing agent. Following the first centrifugation step, the nanoparticles were re-suspended in water, and following the second centrifugation step, 70 μL of a 75% HCl/25% $HNO_3$ acid mixture was added directly to the pellet to dissolve the gold. The resulting solution was sonicated and vortexed to ensure that the pellet was fully broken up, and then allowed to digest for one day at room temperature in polypropylene Eppendorf tubes. Samples were then prepared as described above for ICP analysis. Gold content values from the three samples prepared at each dilution were averaged, and then related to nanoparticle concentration through nanoparticle volume calculations (from TEM). A linear fit with X error of extinction versus nanoparticle concentration was performed in OriginPro 8.6 to determine an extinction coefficient. For this analysis, the intercept was fixed at the origin, and the FV computation method was used. Error associated with measurement of nanoparticle concentration was calculated from ICP measurements of the three samples prepared at each concentration. The slope of this fit was used as the extinction coefficient. The error from this fit was used as the extinction coefficient error.

Figure 11:
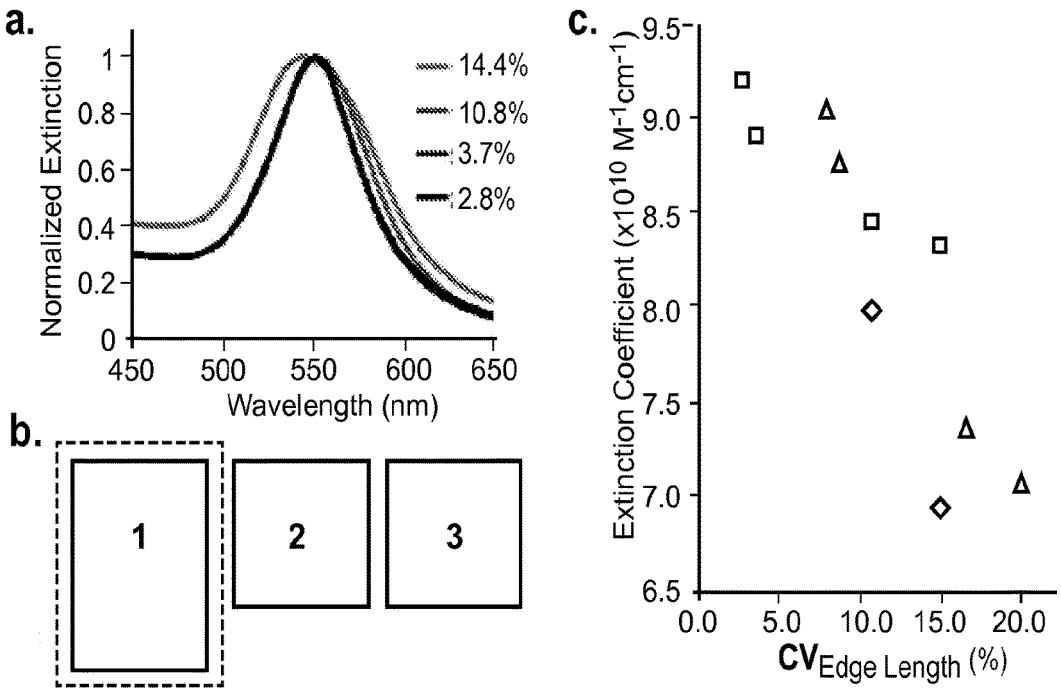
FIG. 11 shows extinction coefficient as a function of dispersity in edge length. (a). Normalized extinction spectra for cubes of varying uniformity, where the legend indicates the coefficient of variation (CV) for each sample. Notably, the FWHM of the LSPR decreases with increasing quality. (b). Example cross-sections of the three cross-sections possible for a rectangular prism, with the most likely to be viewed in TEM boxed in dashed line. (c). Extinction coefficients measured for: cubes with the same average edge length, with extinction measured from the maximum extinction (diamonds); cubes with the same average edge length, with extinction corrected for the breadth in the LSPR (square); and for cubes with the same average volume, with extinction measured from the maximum extinction (triangle).

Extinction Coefficient Determination for Cubes of Varying Quality: To investigate the effect of sample dispersity on extinction coefficient measurement, cubes were grown from seeds of varying dispersity (corresponding to stages 1-4 in FIG. 4), such that their average edge lengths (as determined by our automated program) were the same. Samples were diluted, measured by UV-Vis, digested, and measured by ICP-OES according to the above protocol. However, there are a number of complications that arise in the analysis of low quality samples, which were corrected for (FIG. 11 *a-b*).

The first complication arises from the extinction measurement, normally taken from the maximum of the LSPR. As the quality of the samples decreases, the measured LSPR broadens significantly due to the range of sizes within the sample and no longer fits the expected Lorentzian line shape due to the aspect ratio of the particles (FIG. 11*a*). Therefore, extinction coefficients calculated from the extinction maximum will return lower values than expected. To correct for this, the area under each peak was integrated and normalized each area by the full-width-at-half maximum of the highest quality sample, then recalculated the extinction coefficients (FIG. 11*c*).

The second complication arises from the TEM measurement of nanoparticle dimensions, which only capture a two-dimensional cross-section of a three-dimensional particle (FIG. 11*b*). It is reasonable to assume that the majority of nanoparticles analyzed by TEM dry with their largest area faces lying parallel to the TEM grid surface, meaning that the edge lengths are skewed towards larger values than actual. If correct, this would mean low quality cubes compared in this analysis are actually smaller than calculated, which would return lower than actual extinction coefficients. To correct for this, it was assumed that the minor dimension was representative of the dimension not measured, and this was used to calculate a nanoparticle volume for each measurement. Volumes were then averaged, the standard deviation calculated, and an average edge length determined from this. Extinction coefficients were then recalculated with these changes (FIG. 11*c*). This required additional samples to be analyzed with closer volumes to make comparison between these nanoparticles valid (Table 3).

TABLE 3

From Edge Length

| Sample | Edge Length (nm) | σ (nm) | CV (%) | ε ($\times 10^{10}$ $M^{-1}$ $cm^{-1}$ - from maximum | ε ($\times 10^{10}$ $M^{-1}$ $cm^{-1}$ - from integration |
|---|---|---|---|---|---|
| 1 | 53.9 | 7.8 | 14.5 | 8.30 ± 0.08 | 9.96 ± 0.08 |
| 2 | 51.4 | 7.7 | 15.0 | 6.94 ± 0.02 | 8.33 ± 0.02 |
| 3 | 52.4 | 5.7 | 10.8 | 7.99 ± 0.02 | 8.46 ± 0.03 |
| 4 | 52.3 | 2.0 | 3.7 | 8.92 ± 0.02 | 8.92 ± 0.02 |
| 5 | 52.5 | 1.4 | 2.8 | 9.24 ± 0.01 | 9.24 ± 0.01 |

From Volume

| Sample | Edge Length (nm) | CV (%) | ε ($\times 10^{10}$ $M^{-1}$ $cm^{-1}$ - from maximum | ε ($\times 10^{10}$ $M^{-1}$ $cm^{-1}$ - from integration |
|---|---|---|---|---|
| 1 | 51.6 | 20.0 | 7.28 ± 0.07 | 8.74 ± 0.08 |
| 2 | 49.0 | 20.7 | 6.01 ± 0.02 | 7.21 ± 0.02 |
| 3 | 51.0 | 16.6 | 7.37 ± 0.02 | 7.81 ± 0.02 |
| 4 | 52.0 | 8.8 | 8.76 ± 0.02 | 8.76 ± 0.02 |
| 5 | 52.2 | 8.0 | 9.09 ± 0.01 | 9.09 ± 0.01 |

Importantly, for samples grown from seeds at stages 3 and 4, analysis returned extinction coefficient values within 5% of each other, while cubes grown from seeds at stages 1 and 2 showed dramatically different results. This emphasizes the difficulty in determining the extinction coefficient of highly disperse samples and suggests that samples grown from seeds at stage 3 or 4 are both of sufficient uniformity to use for extinction coefficient determination. The trend in extinction coefficients remains consistent regardless of the correction used and can likely be understood through geometric arguments. Comparing a rectangular prism and a cube of equal volumes, the rectangular prism will possess two dimensions shorter and one dimension longer. For simplicity, each dimension can be approximated as an equal contribution to an ensemble measurement of the nanoparticle extinction. Accordingly, a rectangular prism will possess two blue-shifted dim contributions and one red-shifted bright contribution compared to the cube's three equal contributions. From the measurements, it appears that this decrease in extinction associated with the shorter edge lengths must be greater than the increase in extinction associated with an increased aspect ratio. Recent DDA modeling (Alsawafta et al., *J Nanomaterials* 2012 2012:1) on the effect of aspect ratio and size, simulated separately, for cubes and rectangular prisms suggests this trend would be expected, however, few extinction simulations exist for rectangular prisms or prolate spheroids with constant volume and varied aspect ratio.

Synthesis and Characterization of Anisotropic Nanoparticles: Briefly, seeds after two rounds of reductive growth and oxidative dissolution (stage 3 in FIG. 1) were employed in the synthesis of eight different shapes. For all syntheses, glassware was cleaned with aqua regia to remove trace metal impurities and rinsed thoroughly with Nanopure™ water to ensure residual acid did not affect the pH of the synthesis. All reagents used were trace metals grade and stored in a desiccator. Ascorbic acid and silver nitrate solutions were made immediately before every synthesis, while all other solutions were reused from a stock solution, so long as they were sealed properly to minimize evaporation. It should be noted that the two most common reasons for syntheses to fail were: reducing agent oxidation (within 30 min—1 hour after solution preparation) and seed sedimentation/agglomeration (after 2-4 weeks). Therefore, it is recommended taking appropriate measures for the storage of reducing agents, making fresh reducing agent solutions for every synthesis, and only using seed solutions for up to four weeks after the initial synthesis.

As mentioned briefly above, the three primary ways to characterize the uniformity of a given nanoparticle synthesis are: yield, aspect ratio, and CV. Each of these offers a different piece of information about uniformity and therefore merit a more detailed discussion about what can be learned from each metric.

Yield refers to the percentage of nanoparticles produced in a given synthesis that possess a desired shape, or often times class of shape (for example, cubes and rectangular prisms, both bound by six {100} facets, but with different aspect ratios would be included in the same class of shape). Most often, different shapes are easily identifiable via standard electron microscopy techniques. Herein, the yield of each nanoparticle shape was determined by counting nanoparticles from at least ten unique, non-crystallized regions of each sample via TEM, such that at least 300 nanoparticles were counted in total. For all nanoparticle shapes, except for the THH, this resulted in yields >95%, and post-separation, also resulted in a yield >95% for the THH.

In addition to information about the percentage of nanostructures with a given shape, shape yield is often used as a proxy for crystalline structure. This assumption relies upon two hypotheses: 1. Anisotropic nanoparticle growth proceeds in an epitaxial manner from the seed, and therefore the crystalline structure of the seed dictates the crystalline structure and shape of the product, and 2. A given set of synthetic conditions only produces a single shape per crystalline structure (i.e. only one shape will possess a single crystalline structure, other shapes will possess a non-single crystalline structure with some defect structure). Both of these hypotheses are supported by the majority of this disclosure, however, definitive claims about crystalline structure require a more detailed analysis than performed herein, and the above hypotheses will not always be true. The conclusions on the crystalline structure of the nanoparticles prepared herein come from literature reports for similar syntheses and shapes.

Aspect ratio measures the deviation of a given shape from an idealized geometric solid for nanoparticles within the same class of shapes. Therefore, to calculate an aspect ratio, one must define a reference solid. In the context of the rectangular prism class of shapes, a cube—a rectangular prism with equal edge lengths—is defined as the idealized geometric solid. Deviations from these equal edge lengths can be measured by an aspect ratio, or the ratio of the major and minor dimensions, and increasing aspect ratio would therefore represent a greater deviation from a cube shape. For the nanoparticle seeds, the idealized shape chosen was a sphere. Measurement of aspect ratio was only performed for the study on seeds and cubes, as described in detail above, to track how both the shape and size uniformity of the seed manifest in an anisotropic nanoparticle product. For the other shapes described, grown from refined seeds (without an aspect ratio), aspect ratio is not reported. In principle, aspect ratio could be calculated for all other shapes reported with careful attention to the orientation of the nanoparticles and appropriate selection of an idealized reference solid.

The coefficient of variation, CV, is a ubiquitous, although inconsistently applied metric used to report the variation in size for a class of nanoparticle shapes within a nanoparticle synthesis. CV is determined through measurement of the edge length of large numbers of nanoparticles, preferably with multiple measurements of edge length per nanoparticle (e.g. the two-dimensional cross-section of a cube, as viewed with TEM, enables two independent measurements of edge length). The standard deviation of these measurements is then divided by the average edge length to convert this variation into a fractional (or percentage) deviation rather than an absolute deviation in edge length. CV, as opposed to standard deviation, enables one to compare the size variation between samples of different sizes.

Contained within CV is the "error" of both the nanoparticle synthesis (i.e. variation in absolute dimensions and aspect ratio), as well as the measurement of the nanoparticle dimensions itself. As a result, the CV (if calculated from both minor and major edge lengths for a nanoparticle with an aspect ratio) represents a general metric for variation in both size and shape, for a particular class of shapes produced in a nanoparticle synthesis. If CV is combined with aspect ratio, this allows one to decouple the effect of size variation from shape variation (FIG. 4*d*), and if CV is combined with yield, this gives a more complete version of how uniform the synthesis is at both making a particular shape and at making a particular shape uniform.

Ideally, measurement of CV would be performed via an automated analysis of nanoparticle dimensions, as described above, however for all shapes other than cubes, this was difficult to achieve due to nanoparticle overlap and/or irregular orientations upon drying. Therefore, the ruler tool in Adobe Photoshop was used on high-magnification images. While this is not ideal, reducing measurement subjectivity was most important in determining the relationship between seed quality and anisotropic nanoparticle quality, and one can imagine many of the rigorously determined relationships are translatable across syntheses. To reduce the subjectivity associated with manual measurement, at least 100 nanoparticles were measured, often with multiple dimensions measured per nanoparticle. This analysis was performed across at least ten images, each collected from unique areas of the grid to avoid skewed results associated with local crystallization of similarly sized and shaped nanoparticles. Error in the edge length measurements is related to the magnification and resolution of the images collected, as this determines the pixel size, and therefore the minimum distance that can be measured. For all measurements, this minimum distance was <1 nm.

For the calculation of nanoparticle extinction coefficients, the measured edge lengths were used to calculate the volumes. Because the degree of rounding/corner truncation was difficult to determine for each sample, this effect on volume was ignored for all shapes. Volume calculations performed on large cubes, with corner truncation measured by SEM, returned volumes within 5% of an ideal cube, therefore it was assumed be an acceptable approximation.

Figure 12:
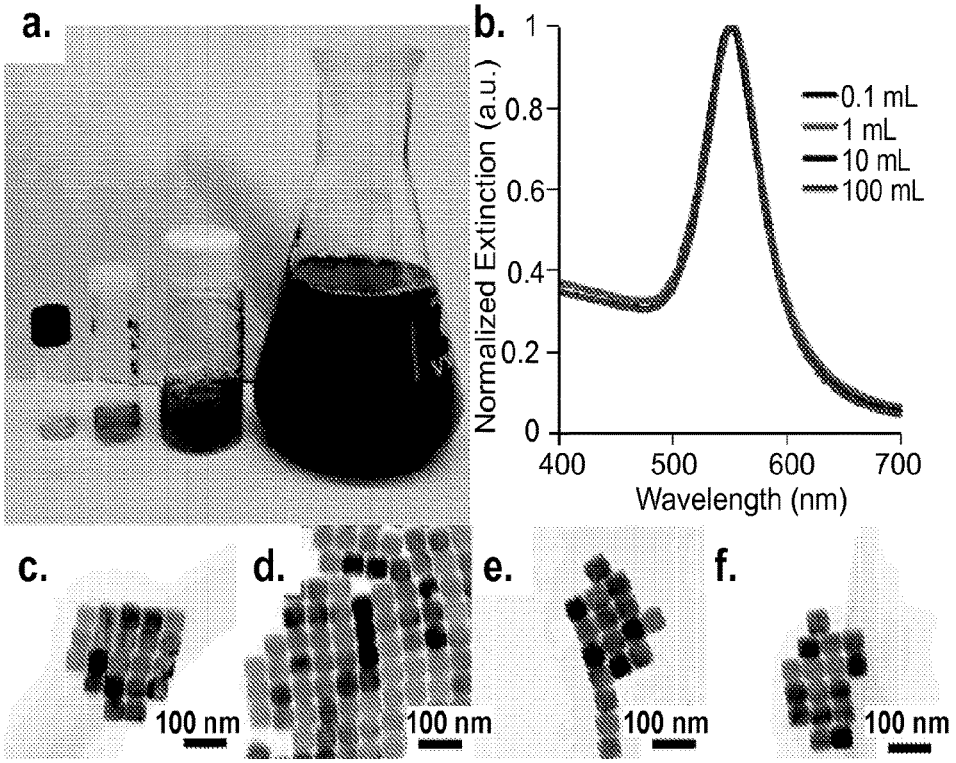
FIG. 12 shows cube reaction volume varied across four orders of magnitude (0.1 mL, 1 mL, 10 mL, and 100 mL) to show that the reaction is scalable with no measurable loss in uniformity. (a). Image of solutions of cubes synthesized at each of the aforementioned volumes. (b). Normalized extinction spectra for each volume. (c).-(f). Representative TEM images for each of the volumes: 0.1 mL, 1 mL, 10 mL, and 100 mL, respectively.
Figure 13:
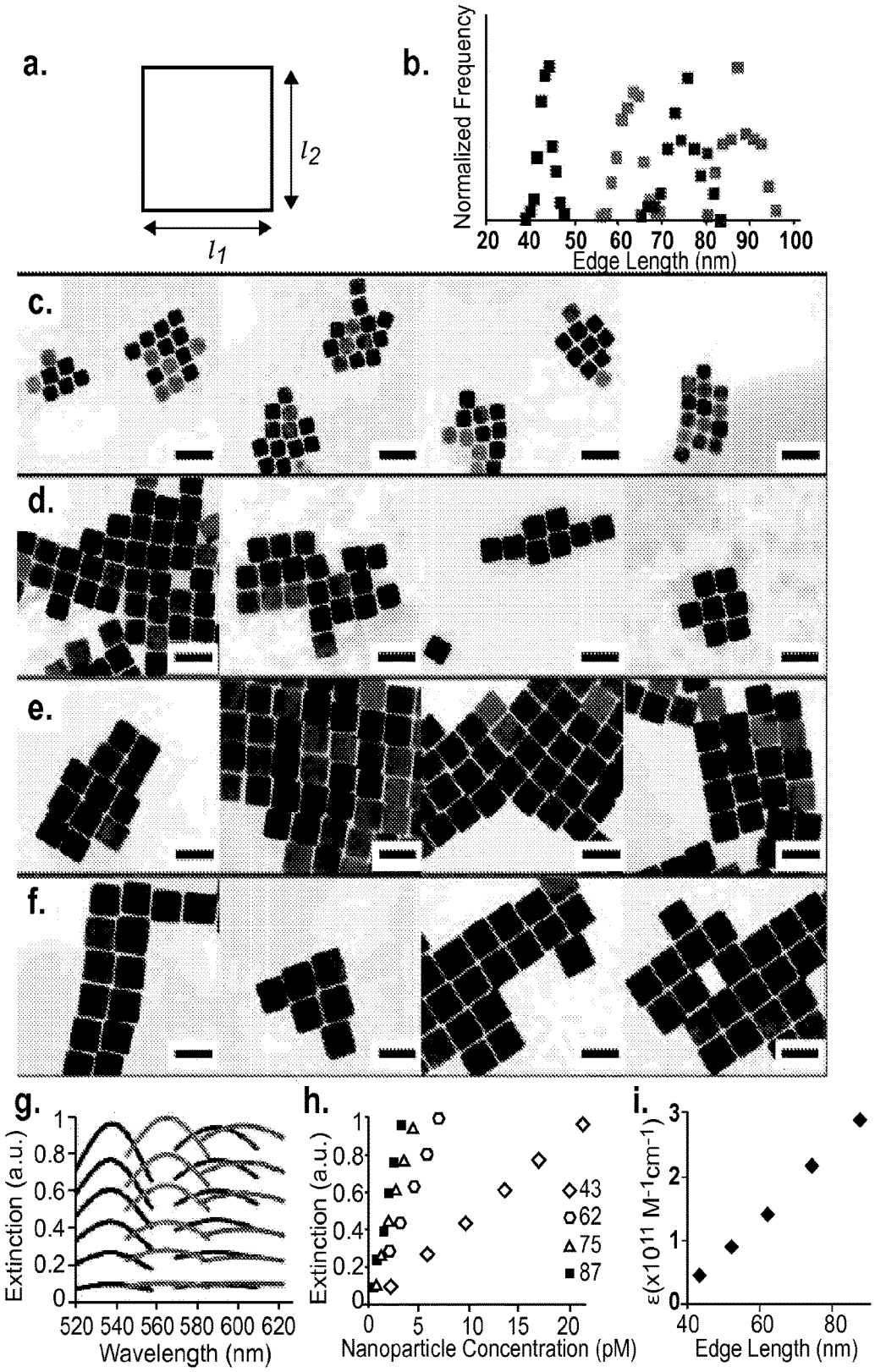
FIG. 13 shows cube extinction coefficient determination. (a). Two dimensions of each cube were measured in an automated fashion. (b). Frequency plots of measured nanoparticle edge length with points taken every 2% of the average value. Frequency is normalized by the total number of measurements for each sample. (c).-(f). TEM images for each of four cube sizes investigated. Scale bars 100 nm. (g). Extinction spectra from dilutions for each of the cube sizes investigated. (h) Extinction at the LSPR versus nanoparticle concentration plots, where the slope of the line represents the extinction coefficient. Legend corresponds to edge lengths. (i). Extinction coefficient plotted versus nanoparticle edge length.

Cubes: Cubes were synthesized using a protocol adapted from Niu, et al, *J. Am. Chem. Soc.,* 2009 131:697. Briefly, 5 mL of 100 mM CPC, 500 μL of 100 mM KBr, 100 μL of 10 mM $HAuCl_4$, and 150 μL of 100 mM ascorbic acid were mixed along with an amount of seeds adjusted to yield a desired cube size (typically, 50-400 μL of seeds at 1 OD concentration). These solutions were allowed to react for ~1 hour before the samples were imaged. It should be noted that all syntheses are reported for 5 mL volumes, however this reaction can be scaled across four orders of magnitude in volume with no measurable change in quality (FIG. 12). Cube volume was determined by cubing the average edge length. Various results are shown in FIG. 13.

Figure 14:
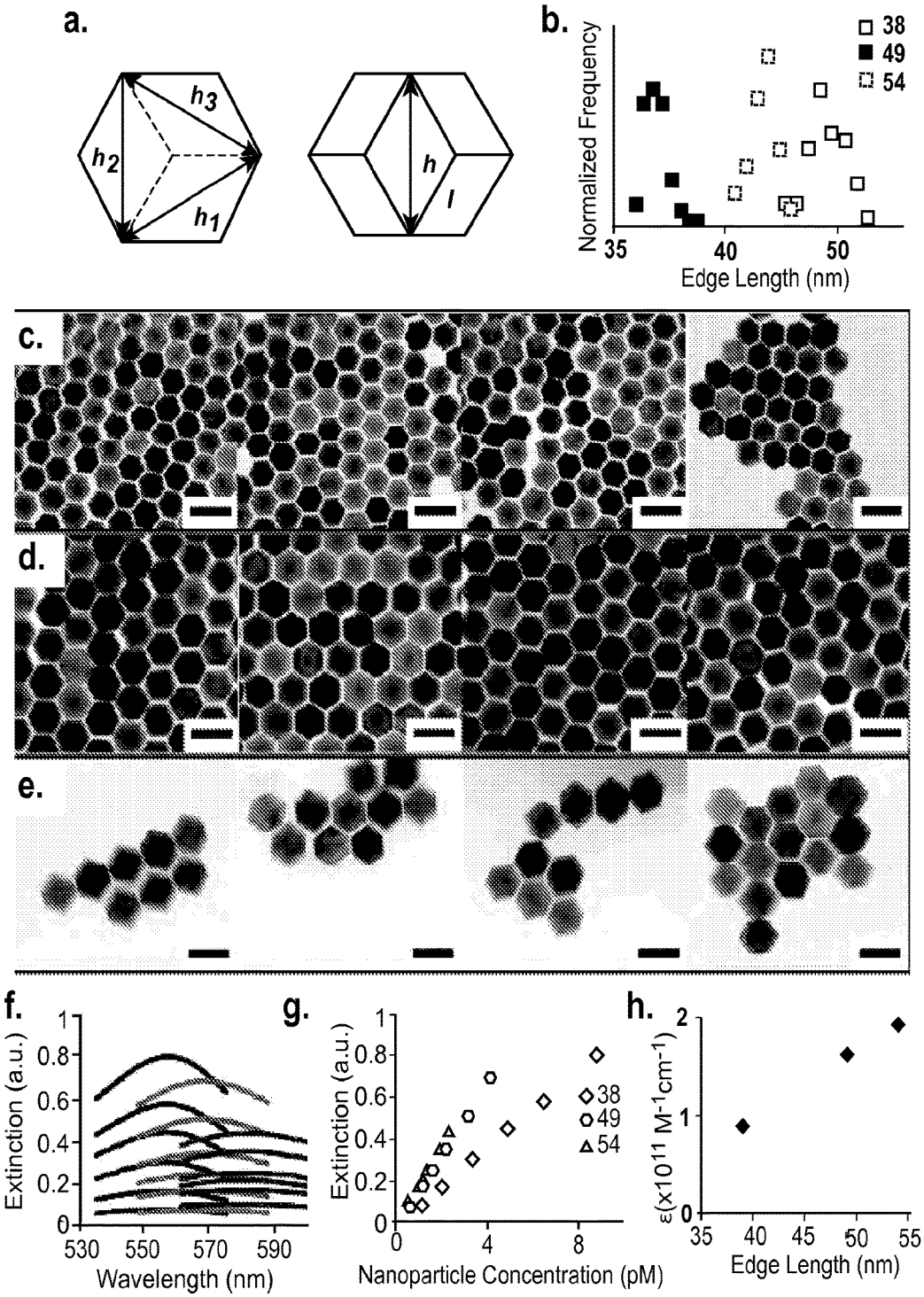
FIG. 14 shows rhombic dodecahedron extinction coefficient determination. (a). Depending on the orientation of the rhombic dodecahedron, either one or three dimensions were measured. (b). Frequency plots of measured nanoparticle edge length with points taken every 2% of the average value. Frequency is normalized by the total number of measurements for each sample. (c).-(e). TEM images for each of the three rhombic dodecahedron sizes investigated. Scale bars 100 nm. (f). Extinction spectra from dilutions for each of the rhombic dodecahedron sizes investigated. (g). Extinction at the LSPR versus nanoparticle concentration plots, where the slope of the line represents the extinction coefficient. Legend corresponds to edge lengths. (h). Extinction coefficient plotted versus nanoparticle edge length.

Rhombic Dodecahedra: Rhombic dodecahedra were prepared with a protocol modified from Lu, et al. *J. Am. Chem. Soc.* 2011 133:18074 for the synthesis of truncated ditetragonal prisms, where the modifications were based upon observations made by Personick, et al. *Nano Lett.* 2011 11:3394. Briefly, 5 mL of 100 mM CPC, 250 μL of 1 M HCl, 250 μL of 10 mM $HAuCl_4$, 13 μL of 10 mM $AgNO_3$, and 30 μL of 100 mM ascorbic acid were mixed with varying seed volumes and allowed to react for 5 hours. Various results are shown in FIG. 14.

The long diagonal of the rhombic face was measured, related to the edge length, and used to calculate the volume through the following equations:

$$l = \frac{h}{2 \cdot \cos\left(\frac{70.53}{2}\right)} \approx 0.612\,h$$

$$\text{Volume} = \frac{16}{9\sqrt{3}} l^3 \approx 0.707\,h^3$$

Truncated Ditetragonal Prisms (TDP): TDPs were synthesized with a protocol modified from Lu, et al. *J. Am. Chem. Soc.* 2011 133:18074. Briefly, 5 mL of 100 mM CPC, 250 μL of 1 M HCl, 250 μL of 10 mM $HAuCl_4$, 35 μL of 10 mM $AgNO_3$, and 35 μL of 100 mM ascorbic acid were mixed with varying seed volumes and allowed to react for 3 hours.

Figure 15:
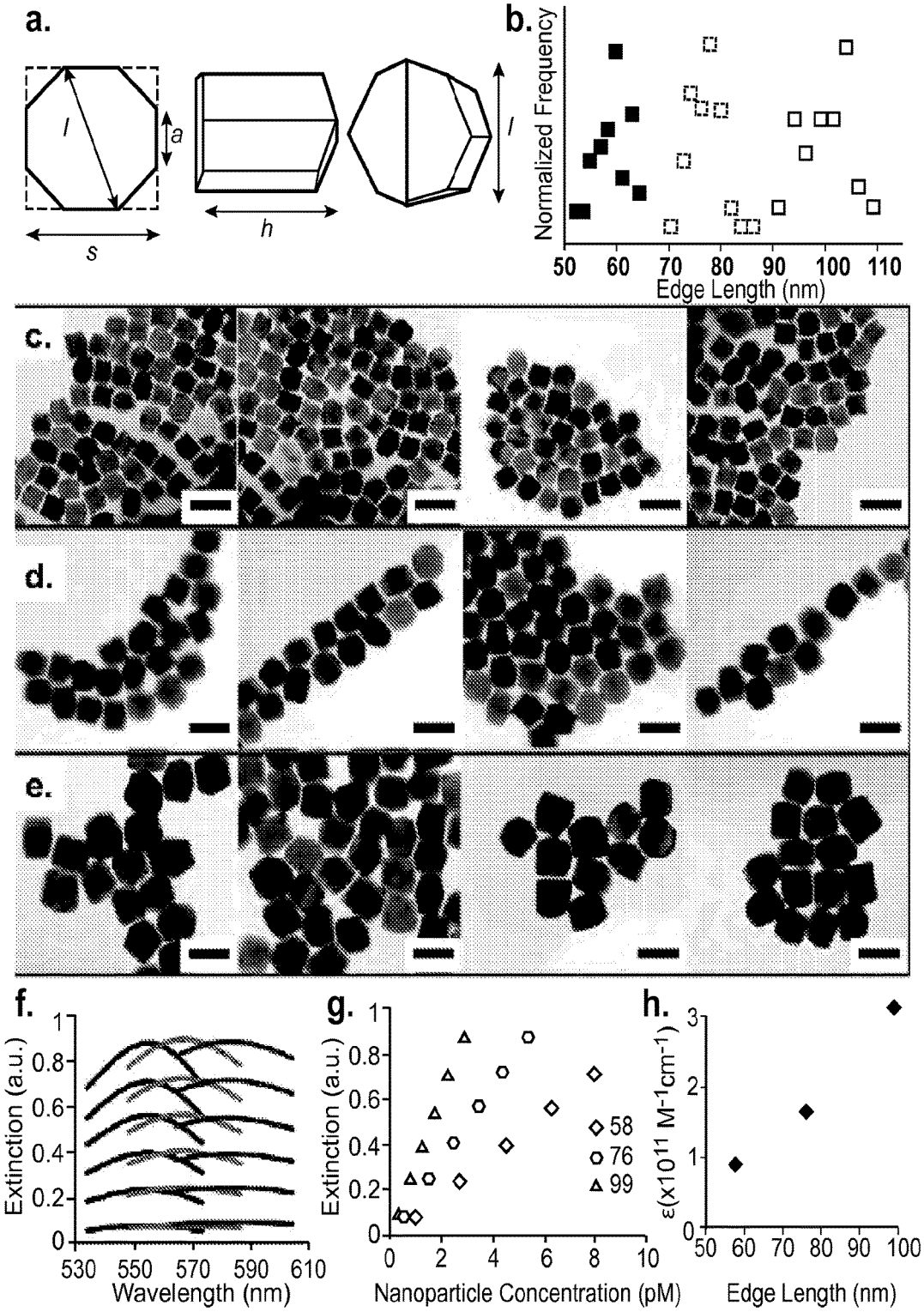
FIG. 15 shows truncated ditetragonal prism (TDP) extinction coefficient determination. (a). TDPs possess an octagonal cross-section (shown at left), but commonly dry with the two orientations at the right, which can be measured separately to determine nanoparticle volume. (b). Frequency plots of measured nanoparticle edge length with points taken every 2% of the average value. Frequency is normalized by the total number of measurements for each sample. (c).-(e). TEM images for each of the three TDP sizes investigated. Scale bars 100 nm. (f). Extinction spectra from dilutions for each of the TDP sizes investigated. (g) Extinction at the LSPR versus nanoparticle concentration plots, where the slope of the line represents the extinction coefficient. Legend refers to height values. (h). Extinction coefficient plotted versus nanoparticle edge length.

TDP volumes were calculated by assuming that the height being measured captures the length from the vertex at one end to the base of the other side, which is reasonable based upon the geometric model displayed in FIG. 15*a* (center) from TEM and SEM analysis. Using this height, rather than the vertex-to-vertex height, allows this to be approximated as an octagonal prism, where the truncated portion excluded plus the truncated portion included should add together to form a full octagonal prism. This height can be related to volume through calculation of the area of an octagon, measured by the corner-to-corner octagon length passing through the center. Accordingly, the volumes can be calculated with the following equations:

$$S = a + 2\left(\frac{a}{\sqrt{2}}\right) \approx 2.41a^2$$

$$l^2 = S^2 + a^2 = 1.172S^2$$

$$A_{octagon} = S^2 - a^2 \approx 0.828S^2 \approx 0.706l^2$$

$$V_{Truncated\ Ditetragonal\ Prism} = 0.706\,l^2 * h$$

Figure 16:
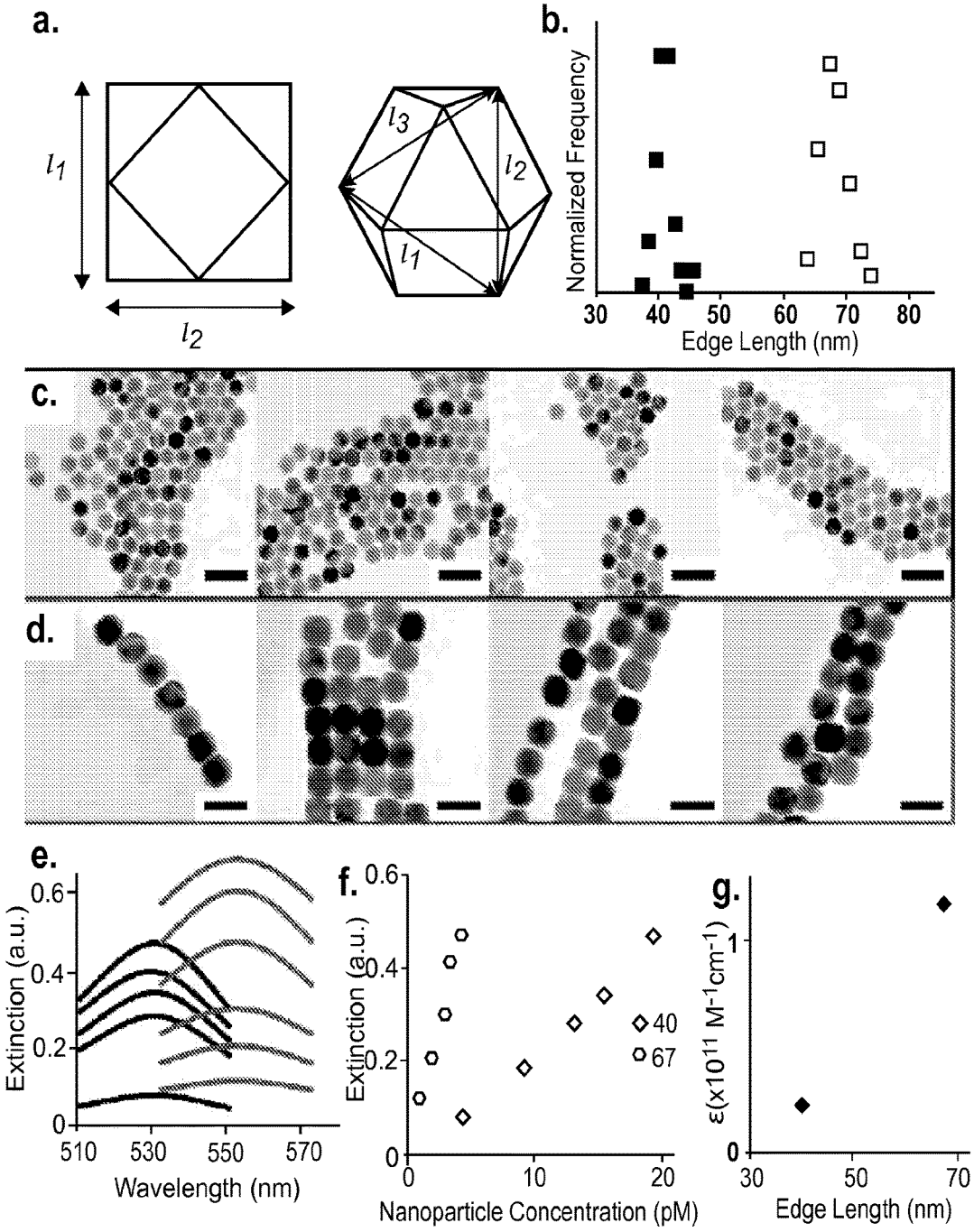
FIG. 16 shows cuboctahedron extinction coefficient determination. a. Cuboctahedra possess either a hexagonal or square cross-section depending on whether they dry with their (111)-triangular face or (100)-square face perpendicular to the substrate. This allows for either three or two measurements, respectively, per nanoparticle. b. Frequency plots of measured nanoparticle edge length with points taken every 2% of the average value. Frequency is normalized by the total number of measurements for each sample. c.-e. TEM images for each of the two cuboctahedron sizes investigated. Scale bars 100 nm. g. Extinction spectra from dilutions for each of the cuboctahedron sizes investigated. Legend refers to edge length values. h. Extinction coefficient plotted versus nanoparticle edge length.

Cuboctahedra: While cuboctahedra have been previously reported as intermediate morphologies in the transition from cubes to octahedra, a seed-mediated synthesis of cuboctahedra has not been reported. Attempts to manipulate reaction rates between that of the octahedra and cubes to isolate this shape were inconclusive here. Instead, it was found that by reducing the gold and ascorbic acid volumes by half in the above synthesis of cubes, with a high concentration of seeds (~1 mL of 1 OD seeds), cuboctahedra could be regularly attained. To manipulate the size, the same procedure was repeated with larger seeds. Seeds larger than ~60 nm did not work for the synthesis of cuboctahedra; therefore, this was the upper size limit investigated. While these conditions suggest that cuboctahedra generated via this method are severely truncated cubes, the degree of truncation appears to be reproducible across the sizes investigated, and in good agreement with expectations for an ideal cuboctahedron. Furthermore, the drying behavior analyzed by TEM and SEM is consistent with a cuboctahedron and significantly different from that of a cube or octahedron. Briefly, 5 mL of 100 mM CPC, 500 μL of 100 mM KBr, 50 μL of 10 mM $HAuCl_4$, and 75 μL of 100 mM ascorbic acid were mixed with seeds and allowed to react for ~2 hours. Various results are shown in FIG. 16.

The measured dimension is related to edge length, and edge length is related to volume, through the following equations:

$$1 = \sqrt{2}a$$

$$\text{Volume} = \tfrac{5}{3}\sqrt{2}a^3 = \tfrac{5}{6}l^3$$

Figure 17:
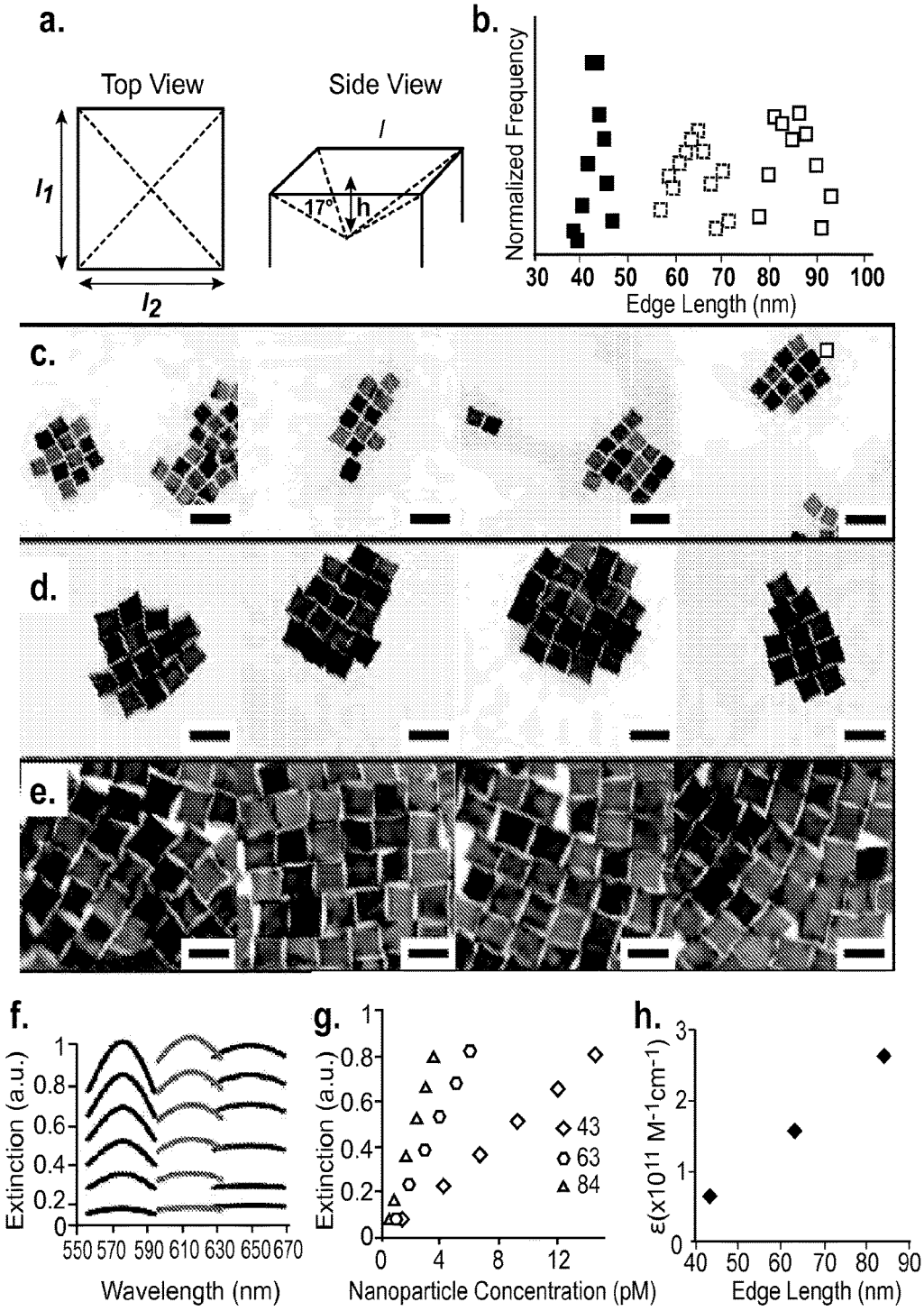
FIG. 17 shows concave cube extinction coefficient determination. (a). Two dimensions of each concave cube were measured. The degree of concavity shown here was determined from Zhang, et al. (ref 10) (b). Frequency plots of measured nanoparticle edge length with points taken every 2% of the average value. Frequency is normalized by the total number of measurements for each sample. (c).-(e). TEM images for each of the three concave cube sizes investigated. Scale bars 100 nm. f. Extinction spectra from dilutions for each of the concave cube sizes investigated. (g) Extinction at the LSPR versus nanoparticle concentration plots, where the slope of the line represents the extinction coefficient. Legend refers to edge length values. (h). Extinction coefficient plotted versus nanoparticle edge length.

Concave Cubes: Concave cubes were prepared with a protocol modified from Lu, et al., *J. Am. Chem. Soc.,* 2011 133:18074 for the synthesis of TDPs, where the modifications were based upon observations made by Personick, et al., *Nano Lett.,* 2011 11:3394. Briefly, 5 mL of 100 mM CPC, 250 μL of 1 M HCl, 250 μL of 10 mM $HAuCl_4$, 62.5 μL of 10 mM $AgNO_3$, and 47.5 μL of 100 mM ascorbic acid were mixed with varying seed volumes and allowed to react for 2 hours. Various results are shown in FIG. 17.

The volume of a concave cube was calculated by subtracting the volume of a square pyramid from the faces of a cube. The degree of concavity, effectively the angle between the base and sides of the square pyramid, is determined from a previous report on concave cubes (see, e.g., Zhang, et al., *J. Am. Chem. Soc.,* 2010 132:14012). The volume is therefore calculated from the following set of equations:

$$h = \tan(17) \cdot \frac{l}{2}$$

$$\text{Volume}_{Square\ Pyramid} = \frac{1}{3} B \cdot h = \frac{\tan(17)}{6} \cdot l^3 \approx 0.051\, l^3$$

$$\text{Volume}_{Concave\ Cube} = l^3 - 6 \cdot \frac{\tan(17)}{6} \cdot l^3 \approx 0.694\, l^3$$

Tetrahexahedra (THH): THH were synthesized via a modified protocol from Jones, et al., *Nat. Mater.,* 2010 9:913. Briefly, 10 mL of 100 mM CTAB, 500 μL of 10 mM $HAuCl_4$, 200 μL of 1 M HCl, 100 μL of 10 mM $AgNO_3$, and 65 μL of 100 mM ascorbic acid were mixed with varying volumes of seeds and allowed to react for 6 hours. This produces a mixture of THH and hexagonal bypramids, which suggests that seed defect structure alone does not dictate the defect structure of the product. The single crystalline THH can be separated from the planar-twinned hexagonal bipyramids (HB) in near quantitative yield through a simple sedimentation process. Because the HB are significantly larger, they fall out of solution at a much faster rate than the THH, which after the appropriate amount of time leaves solely THH suspended in solution. This supernatant can be isolated and the quality confirmed by correlated UV-Vis and TEM analysis. Further proof comes from the crystallization behavior of these solutions, analyzed by SEM, which show large domains minimally interrupted by HB impurities, and few small areas of solely HB. Briefly, small THH (<50 nm) can be separated after ~3 weeks, or the process can be expedited through several rounds of low speed centrifugation. Medium THH (50-70 nm) can be separated after ~2-3 days, as described above. Large THH (>70 nm) must first be centrifuged and resuspended in water, as the depletion force assembly of THH causes them to sediment at a similar rate to the HB. Then, they can be separated after ~3 days.

A tetrahexahedron can be modeled as a cube with square pyramids extending from each face, characterized by the edge length of the inscribed cube (l) and a height of the square pyramid (h). While the edge length was reported in Table 2, the height was not. To determine height, and therefore volume, additional measurements were performed of the tip-to-tip distance from opposite square pyramids. For the three sizes of THH investigated, these tip-to-tip distances were 62±2, 90±3, and 111±5, respectively. Subtracting the edge length from this value and dividing by two provides the height of the square pyramid. Volume was accordingly calculated from the following equations:

$$Vol_{SquarePyramid} = \frac{l^2 \cdot h}{3}$$

$$Vol_{THH} = 6 - Vol_{SquarePyramid} + l^3$$

Figure 18:
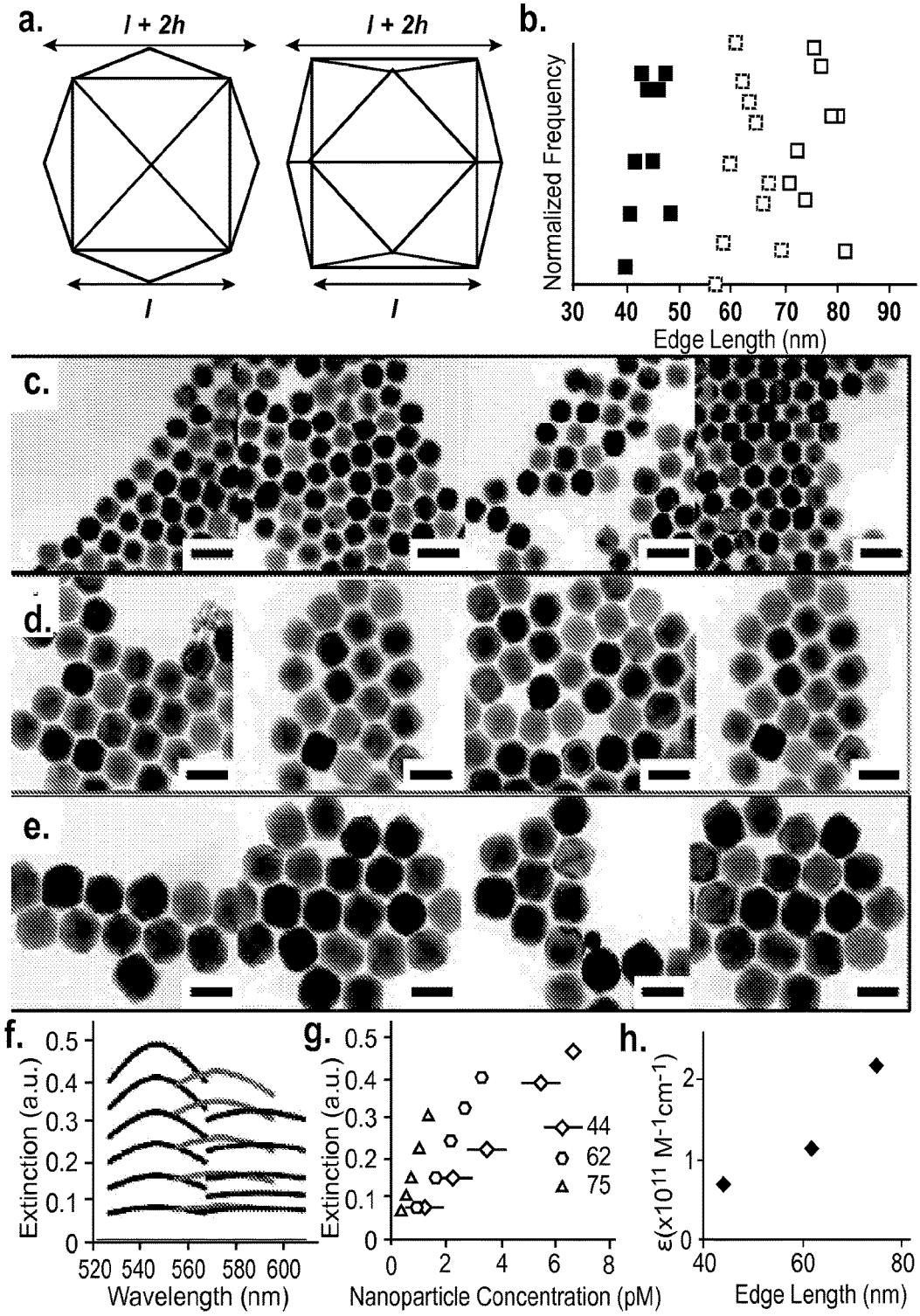
FIG. 18 shows tetrahexahedra extinction coefficient determination (a). THH can be described as cubes with square pyramids extending from each face, whose dimensions are determined from the edge lengths of the cube. (b). Frequency plots of measured nanoparticle edge length with points taken every 2% of the average value. Frequency is normalized by the total number of measurements for each sample (c).-(e). TEM images for each of the three THH sizes investigated. Scale bars 100 nm. (f). Extinction spectra from dilutions for each of the THH sizes investigated. Legend refers to edge length values. (g) Extinction at the LSPR versus nanoparticle concentration plots, where the slope of the line represents the extinction coefficient. (h). Extinction coefficient plotted versus nanoparticle edge length.

Various results are shown in FIG. 18

Octahedra: Octahedra were synthesized via a protocol reported in Niu, et al., *J. Am. Chem. Soc.,* 2009 131:697. Briefly, 5 mL 100 mM CPC, 100 μL 10 mM $HAuCl_4$, 13 μL of 100 mM ascorbic acid, and varying seed volumes were mixed and allowed to react for 30 minutes.

Octahedron volume was determined by the equation:

$$\text{Volume} = \frac{\sqrt{2}}{3} l^3$$

Figure 19:
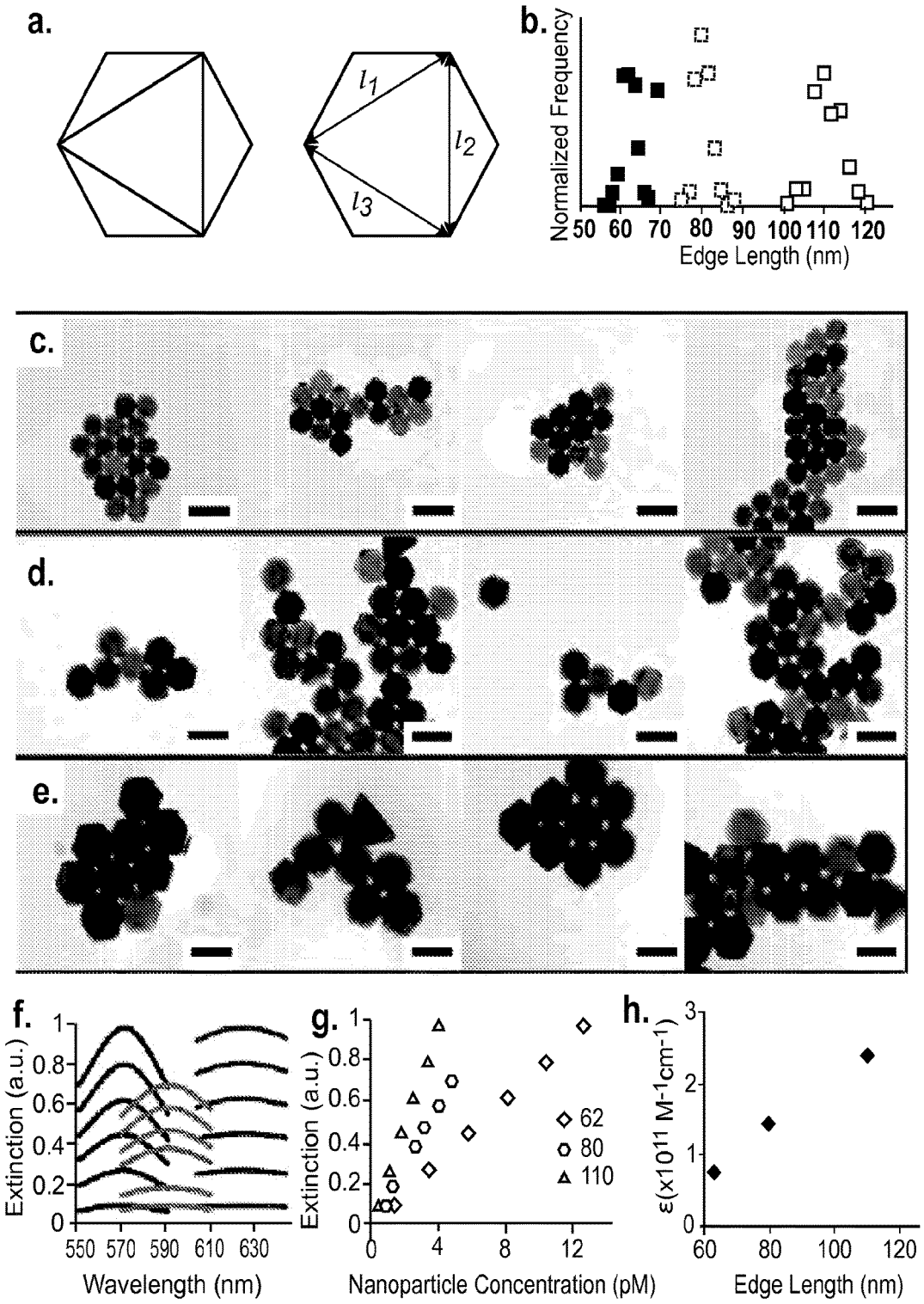
FIG. 19 shows octahedra extinction coefficient determination (a). Three dimensions of each octahedron were measured. (b). Frequency plots of measured nanoparticle edge length with points taken every 2% of the average value. Frequency is normalized by the total number of measurements for each sample (c).-(e). TEM images for each of the three octahedron sizes investigated. Scale bars 100 nm. (f). Extinction spectra from dilutions for each of the octahedron sizes investigated. (g) Extinction at the LSPR versus nanoparticle concentration plots, where the slope of the line represents the extinction coefficient. Legend refers to edge length values. (h). Extinction coefficient plotted versus nanoparticle edge length.

Various results are shown in FIG. 19

Figure 20:
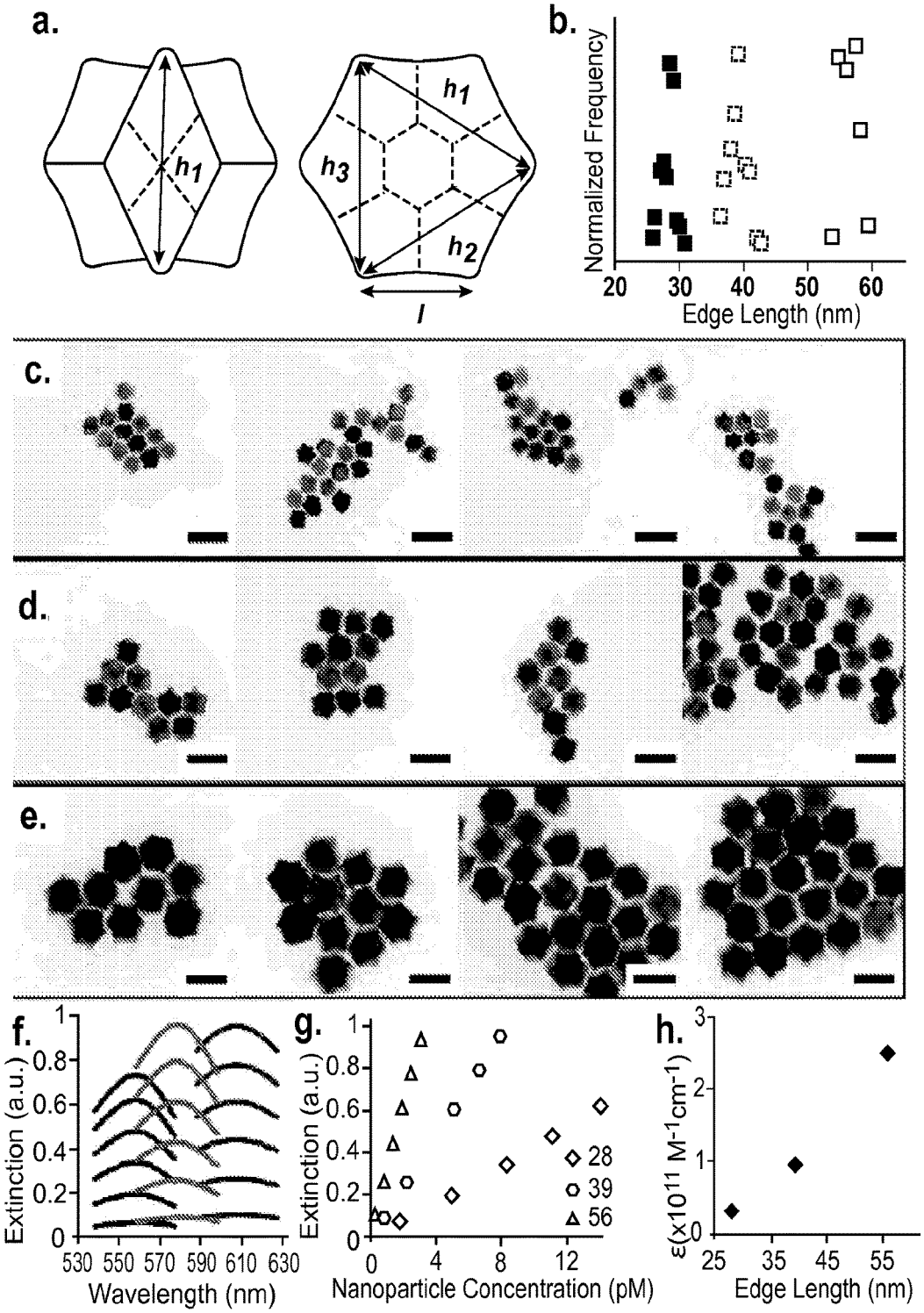
FIG. 20 shows concave rhombic dodecahedron extinction coefficient determination (a). Depending on the orientation of the concave rhombic dodecahedron, either one or three dimensions were measured. (b). Frequency plots of measured nanoparticle edge length with points taken every 2% of the average value. Frequency is normalized by the total number of measurements for each sample (c).-(e). TEM images for each of the three concave rhombic dodecahedron sizes investigated. Scale bars 100 nm. (f). Extinction spectra from dilutions for each of the concave rhombic dodecahedron sizes investigated. Legend corresponds to edge lengths. (g) Extinction at the LSPR versus nanoparticle concentration plots, where the slope of the line represents the extinction coefficient. Legend refers to edge length values. (h). Extinction coefficient plotted versus nanoparticle edge length.
Figure 21:
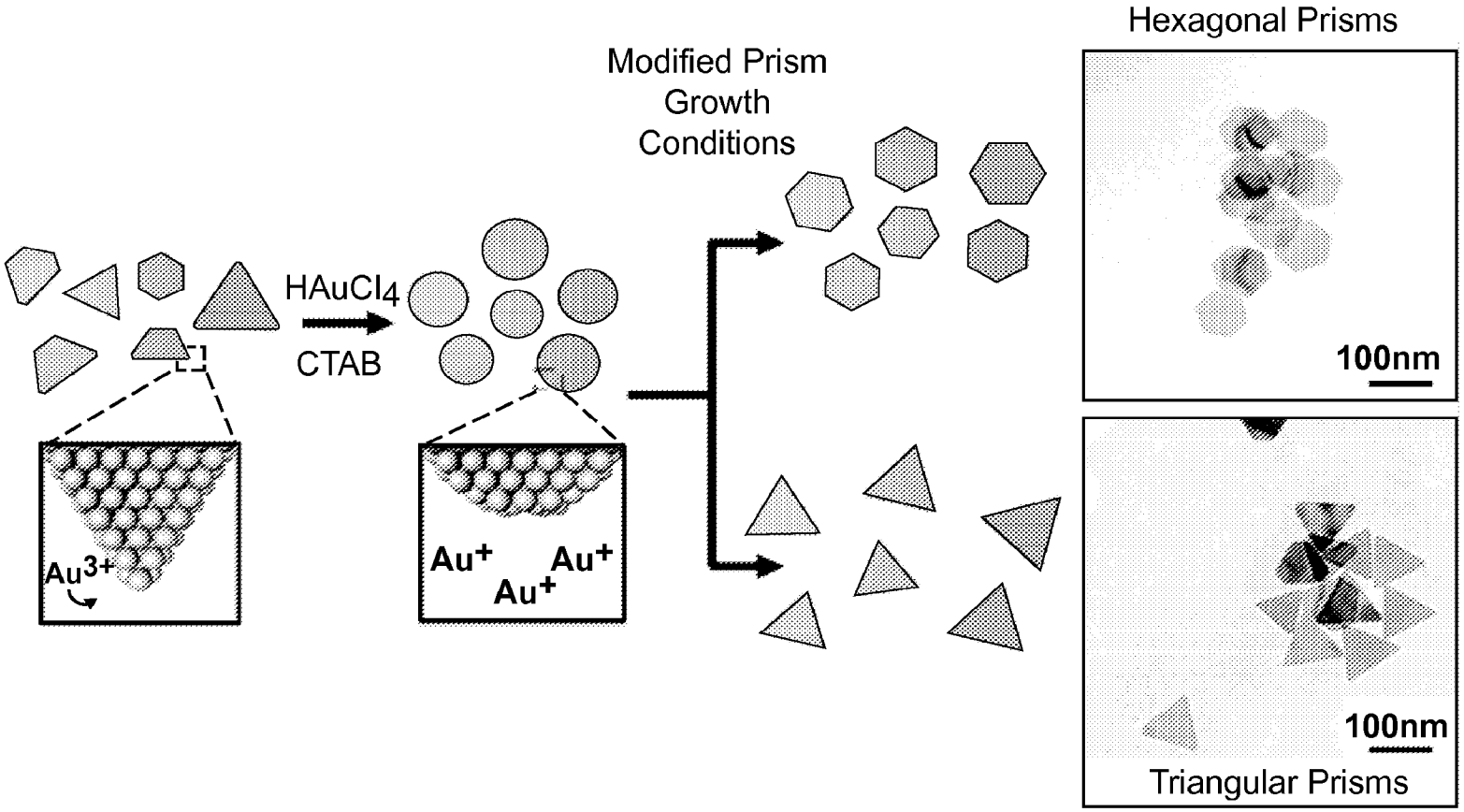
FIG. 21 shows how circular disk seeds can be generated and used as precursors for the synthesis of other two-dimensional nanoparticles, including hexagonal prisms and triangular prisms.

Concave Rhombic Dodecahedra (CRD): CRD were synthesized with a protocol modified from Niu, et al., *J. Am. Chem. Soc.,* 2009 131:697. Briefly, 5 mL 10 mM CPC, 100 μL of 10 mM $HAuCl_4$, and 1.13 mL ascorbic acid were mixed with varying volumes of seeds. Various results are shown in FIG. 20.

In the literature, there is a lack of consensus about the geometric form of this nanoparticle. Either the shape has been described as a rhombic dodecahedron, which assembly behavior has confirmed (see Jones et al., *Nat. Mater.* 2010 9:913), or a trisoctahedron (see Langille et al., *J. Am. Chem. Soc.* 2012 134:14542; Hong et al., *J. Am. Chem. Soc.* 2012 134:4565; and Yu et al., *J Phys Chem C,* 2010 114:11119), due to the additional faceting beyond what would be expected for a rhombic dodecahedron. High-magnification SEM and atomic force microscopy (AFM) analysis of the structures confirms they are indeed closely related to rhombic dodecahedra, however each rhombic face possesses a concave feature, which accounts for the structural discrepancies. Volume was calculated by subtracting rhombic pyramids from each face of a rhombic dodecahedron, where the depth (d) of each pyramid was estimated by AFM analysis, using the following equations:

$$\text{Volume}_{Rhombic\ Pyramid} = \frac{1}{3}\left(\frac{1}{2} \cdot \frac{l^2}{\sqrt{2}}\right) \cdot d = \frac{h^2 \cdot d}{6\sqrt{2}}$$

$$\text{Volume}_{CRD} \approx 0.707 h^3 - 12 \cdot \frac{h^2 \cdot d}{6\sqrt{2}}$$

Circular Disk Nanoparticle Seeds

To synthesize circular disk nanoparticles, triangular prism nanoparticles were synthesized, purified, and then etched to circular prisms. Triangular prism nanoparticles were synthesized according to a previous literature report by Jones, et al., *Angew. Chem. Int. Ed.,* 2013 52:2886. The synthesis of triangular prism nanoparticles results in a significant number of pseudo-spherical nanoparticle impurities. To isolate the triangular prism nanoparticles, a depletion-force mediated procedure reported by Young, et al., *PNAS USA,* 2012 109:2240 was utilized. Briefly, the as-synthesized mixed nanoparticle solutions were heated for 1-2 minutes to dissolve any crystallized CTAB, then allowed to cool for —5 minutes. Next, 10 mL aliquots of the triangular prism mixture were pipetted into 15 mL Falcon tubes. To each of these mixtures, a specific volume of 2 M NaCl was added to screen the electrostatic repulsion between nanoparticles, and allow the preferential assembly of triangular prism nanoparticles via depletion forces. The table below shows volumes of 2 M NaCl required per 10 mL of as-synthesized nanoparticles for depletion force isolation of triangular prisms. The volume of 2 M NaCl necessary for this process is dependent on the size of the triangular nanoprisms. Upon NaCl addition, the samples were vortexed thoroughly and allowed to sit for 2 hours. After this time, the nanoparticle solutions were centrifuged for 30 seconds at 3,300 rcf and the supernatant removed. A second centrifugation step was performed for ~5 seconds at 250 rcf, and the supernatant removed again. Then, 10 mL of 50 mM CTAB was added to each tube and vortexed thoroughly to return all nanoparticles to solution.

| Nanoparticle Edge Length (nm) | Volume of 2M NaCl added to 10 mL NPs (mL) |
|---|---|
| 60-100 | 2.0 |
| 110-130 | 1.0 |
| 140-160 | 0.50 |
| 170-200 | 0.25 |
| >200 | 0.10 |

To determine the concentration of triangular prisms, the nanoparticle solution was diluted by a factor of 10 to disrupt any depletion force association of nanoparticles, then measured with a UV-Vis-NIR spectrophotometer. Based upon the LSPR position of the nanoparticles, an extinction coefficient can be calculated according to Jones, et al. *Angew. Chem. Int. Ed.,* 2013 52:2886 using the equation:

$$\varepsilon=1.6888\times10^{8}*\exp(5.1742\times10^{-3}*\lambda_{max})$$

Using the extinction at $\lambda_{max}$ and the extinction coefficient, the concentration of this "stock solution" can be calculated. Nanoparticle solutions for oxidative dissolution were then prepared by diluting the purified triangular prism stock solution with 50 mM cetyltrimethylammonium bromide (CTAB, BioWorld) to the concentrations listed in Table 1. If the nanoparticles were not concentrated enough initially, they can be centrifuged one additional time (see Table 4 for centrifugation conditions), the supernatant removed, and the nanoparticles resuspended in a smaller volume of 50 mM CTAB. If any CTAB had crystallized, nanoparticle solutions were briefly heated and then allowed to cool to room temperature. Note: this is ideally done in an Erlenmeyer flask with a stir bar, as heating of a crystallized CTAB solution without stirring results in a viscous gel at the bottom of the flask that is difficult to dissolve.

Triangular prisms were then oxidized under controlled conditions adapted from Rodriguez-Fernandez, et al., *J. Phys. Chem. B.,* 2005 109:14257 and O'Brien, et al., *J. Am. Chem. Soc.* 2014 136:7603 First, $HAuCl_4$ (10 mM) was added to the nanoparticle and CTAB mixture (NP concentration specified in Table 1, CTAB concentration 50 mM) under vigorous stirring to bring the final concentration of $HAuCl_4$ to that listed in Table 1 (it is assumed that the volume of $HAuCl_4$ is negligible compared to the volume of the nanoparticle solution). After the solution was mixed thoroughly, the solution was placed in a temperature-controlled water bath at 28° C. for 4 hours. After this time, the solution was centrifuged (see Table 4), the supernatant removed, and the nanoparticles resuspended in a small volume of 50 mM CTAB. This centrifugation step removes liberated $Au^+$ species from solution and prevents an undesired redeposition side reaction. Consequently, it is important that this be done soon after allowing 4 hours for the etching reaction to go to completion. This procedure can be scaled from 0.5 mL to 500 mL depending on the desired quantity of nanoparticles.

TABLE 4

| Nanoparticle Size (nm) | Centrifugation in 50 mM CTAB | Centrifugation in <20 mM CTAB |
|---|---|---|
| 30-60 nm | 12 min at 11,300 rcf | 12 min at 11,300 rcf |
| 60-110 nm | 10 min at 9,400 rcf | 10 min at 9,400 rcf |
| 110-200 nm | 8 min at 3,400 rcf | 8 min at 6,000 rcf |

To prepare the nanoparticles for TEM imaging, a 50 μL aliquot of the nanoparticle solution was placed into a 1.5 mL Eppendorf tube and diluted to 1 mL with nanopure water. Samples were then centrifuged according to the conditions listed in Table S2, the supernatant removed, and the pellet resuspended in 50 μL of nanopure water. 8 μL of this nanoparticle solution was pipetted onto a TEM grid, followed by the addition of 1 μL of a solution of a short-chain thiolated oligoethyleneglycol (OEG-SH; Quanta BioDesign, Thiol-$dPEG_4$-acid; prepared by adding 1 μL of polymer per 1 mL of $H_2O$). After mixing the OEG-SH with the nanoparticle solution on the grid, samples were allowed to dry in a vacuum dessicator at room temperature before imaging. The dilution and centrifugation steps remove some CTAB from solution, which will otherwise crystallize and obscure the nanoparticles from view during TEM imaging, and the OEG-SH passivates the nanoparticle surface to prevent corner rounding or other shape transformations during the drying process. To estimate nanoparticle thickness, the above conditions were modified to prefer an orientation perpendicular to the TEM grid. These modifications included an increase in the initial nanoparticle concentration by a factor of 2 and allowing the grid to dry in a high humidity environment.

Image analysis was performed in Adobe Photoshop on at least 100 nanoparticles per sample. Briefly, the magnetic lasso tool was used under optimized tolerance conditions to trace the outline of each nanoparticle. Then, the measure tool was used to determine an area and perimeter of each nanoparticle. For these samples, edge length (L) in the case of triangular prisms, diameter (D) in the case of circular prisms, and standard deviations, or dispersities (denoted by σ), were determined from the area (A) and perimeter (P) according to the following equations:

$$L=\frac{P}{3}\text{ and }\sigma_L=\frac{\sigma_P}{3}$$

$$L=\sqrt{\frac{4A}{\sqrt{3}}}\text{ and }\sigma_L=\frac{2\sigma_A}{L\sqrt{3}}$$

$$D=\frac{P}{\pi}\text{ and }\sigma_D=\frac{\sigma_P}{\pi}$$

$$D=\sqrt{\frac{4A}{\pi}}\text{ and }\sigma_D=\frac{2\sigma_A}{\pi D}$$

$$L=\frac{P}{3}\text{ and }\sigma_L=\frac{\sigma_P}{3}$$

$$L=\sqrt{\frac{4A}{\sqrt{3}}}\text{ and }\sigma_L=\frac{2\sigma_A}{\sqrt{3}}$$

$$D=\frac{P}{\pi}\text{ and }\sigma_D=\frac{\sigma_P}{\pi}$$

$$D=\sqrt{\frac{4A}{\pi}}\text{ and }\sigma_A=\frac{2\sigma_A}{\pi D}$$

The plasmonic properties of the circular disks were modeled with the discrete dipole approximation method (DDA).

Details of the DDA method have been highlighted by many authors, such as Purcell et al., *Astrophysics J.,* 1973 186: 705; Draine, et al., *J. Opt. Soc. Am. A.,* 1994 11:1491; and Yurkin et al., *J. Quant. Spectrosc. Radiat. Transfer,* 2007 106:558. Essentially, the Au circular disks were decomposed into a lattice of point dipoles, each having microscopic polarizability. An incident light (plane) wave causes each dipole to interact via a local electric field and the incident field. A lattice dispersion relation (LDR) ensures that the discrete solution to Maxwell's Equation reproduces that of continuous media. The Gutkowicz-Krusin-Draine-LDR was used, which corrects for errors in previous LDRs and requires no knowledge of the particle shape (Gutkowicz-Krusin et al., arXiv: astro-ph/0403082v1 2004) The DDSCAT solver package was used to calculate the scattering and extinction cross-sections. (Draine et al., arXiv: 1002.1505v1 2010) The spacing between the lattice dipoles was always kept between 0.5-1 nm, depending on the particle size and curvature.

The dielectric functions of the nanoparticles were calculated from Johnson and Christy's (JC) bulk measurements for both gold and silver. The JC data was fit using the model of Etchegoin with parameters shown above. The model of Etchegoin et al., *J. Chem. Phys.,* 2006 125:164705 is of the form:

$$\varepsilon(\omega) = \varepsilon'_\infty - \frac{1}{\lambda_p^2(\lambda^{-2} + i\gamma_p^{-1}\lambda^{-1})} + \sum_j \frac{a_j}{\lambda_j}\left(\frac{e^{i\pi_j}}{\lambda_j^{-1} - \lambda^{-1} - i\gamma_j^{-1}} + \frac{e^{-i\pi_j}}{\lambda_j^{-1} - \lambda^{-1} - i\gamma_j^{-1}}\right)$$

The silver fitted parameters of ε(ω) are detailed in Blaber et al., *J. Phys. Chem. C,* 2012 116:393.

| Parameter | Value |
|---|---|
| $\lambda_p$ (nm) | 145 |
| $\gamma_p$ (nm) | 14500 |
| $\varepsilon'_\infty$ | 1.53 |
| $a_1$ | 0.94 |
| $\lambda_1$ (nm) | 468 |
| $\gamma_1$ (nm) | 2300 |
| $\pi_1$ | −0.785398 |
| $a_2$ | 1.36 |
| $\lambda_2$ (nm) | 331 |
| $\gamma_2$ (nm) | 940 |
| $\pi_2$ | −0.785398 |

In order to accurately predict the plasmon lifetimes of nanoparticles a surface scattering treatment is necessary in the dielectric function. To first approximation the bulk scattering rate $\gamma_{bulk}$ is additive with the surface scattering rate $\gamma_{scat}$ such that $\gamma=\gamma_{bulk}+\gamma_{scat}$. For metal nanoparticles the scattering rate $\gamma_{scat}$ is inversely proportional to the electron mean free path $l_{scat}$. A commonly used expression is $\gamma_{scat}=Av_F l_{scat}^{-1}$. (see Coronado et al., *J. Chem. Phys.,* 2006 125:164705) Here, A, the scattering efficiency, is set to one and the $v_F$ is the Fermi velocity of gold ($1.40\times10^8$ $ms^{-1}$). The mean free path is dependent on the nanoparticle geometry and therefore an effective mean free path is used $\tilde{l}_{scat}$. For thin nanodisks (T<20 nm), the in-plane longitudinal modes of the nanodisk have an effective mean free path of $\tilde{l}_{scat}=D$. For thinner disks, the scattering in the transverse direction is no longer negligible. The out-of-plane transverse modes have an effective path of $\tilde{l}_{scat}\sim T$, which is what is predicted by a geometrical approach to random scattering. Namely, $\tilde{l}_{scat}=4V/S\sim T$, where V and S are the volume and surface area, respectively. For the two smallest disks (33 nm and 46.5 nm), the surface scattering contribution is the major contributor to the line width. The line widths quickly decrease for larger sizes as the scattering contribution decays. For the largest disk (118 nm), the line width increases again due in part to the intrinsic non-radiative ($\Gamma_{NR}$) damping of gold increasing in the near-IR. A similar surface scattering treatment was done for silver disks as detailed in Blaber et al., *J. Phys. Chem. C,* 2012 116:393.

Triangular and hexagonal prisms are prepared from the circular disk nanoparticle seeds using the following reagents: CTAB (stabilizing agent), NaI (halide salt), NaOH (base), ascorbic acid, HAuCl4 (gold salt), circular disks. For triangular prisms the molar ratio of ascorbic acid to $HAuCl_4$ to circular disks of 2,500:5,000:1 is used. For hexagonal prisms, the ratio used is 500:1,000:1.

Similar conditions for preparation of the triangular and hexagonal bipyramids are used, except the halide salt is not used and a silver salt (e.g., silver nitrate) is used.

REFERENCES

Circular Disk Nanoparticle Seeds (1) Rosi, et al. *Chem. Rev.* 2005, 105, 1547-1562.
(2) Willets, et al. *Annu. Rev. Phys. Chem.* 2007, 58, 267-297.
(3) Anker, et al. *Nat. Mater.* 2008, 7, 442-453.
(4) Engheta *Science* 2007, 317, 1698-1702.
(5) Stebe, et al. *Science* 2009, 325, 159-160.
(6) Stiles, et al. *Annu. Rev. Anal. Chem.* 2008, 1, 601-626.
(7) Lal, et al. *Chem. Soc. Rev.* 2008, 37, 898-911.
(8) Atwater, et al. *Nat. Mater.* 2010, 9, 205-213.
(9) Linic, et al. *Nat. Mater.* 2011, 10, 911-921.
(10) Schuller, et al. *Nat. Mater.* 2010, 9, 193-204.
(11) Kelly, et al. *J. Phys. Chem. B* 2003, 107, 668-677.
(12) Shuford, et al. *J. Chem. Phys.* 2005, 123, 114713.
(13) Xia, et al. *Angew. Chem. Int. Ed.* 2009, 48, 60-103.
(14) Tao, et al. *Small* 2008, 4, 310-325.
(15) Jones, et al. *Chem. Rev.* 2011, 111, 3736-3827.
(16) Grzelczak, et al. *Chem. Soc. Rev.* 2008, 37, 1783-1791.
(17) Lofton, et al. *Adv. Funct. Mater.* 2005, 15, 1197-1208.
(18) O'Brien, et al. *J. Am. Chem. Soc.* 2014, 136, 7603-7606.
(19) Jain, et al. *J. Phys. Chem. B* 2006, 110, 7238-7248.
(20) Jones, et al. *Angew. Chem. Int. Ed.* 2013, 52, 2886-2891.
(21) Nikoobakht, et al. *Chem. Mater.* 2003, 15, 1957-1962.
(22) Xia, et al. *Adv. Mater.* 2003, 15, 353-389.
(23) Lohse, et al. *Chem. Mater.* 2013, 25, 1250-1261.
(24) Ye, et al. *ACS Nano* 2012, 6, 2804-2817.
(25) Ye, et al. *Nano Lett.* 2013, 13, 765-771.
(26) Millstone, et al. *Small* 2009, 5, 646-664.
(27) Millstone, et al. *J. Am. Chem. Soc.* 2005, 127, 5312-5313.
(28) Millstone, et al. *Nano Lett.* 2008, 8, 2526-2529.
(29) Halas, *MRS Bull.* 2005, 30, 362-367.
(30) Skrabalak, et al. *Acc. Chem. Res.* 2008, 41, 1587-1595.
(31) Ghosh Chaudhuri, et al. *Chem. Rev.* 2012, 112, 2373-2433.
(32) Scarabelli, et al. *ACS Nano* 2014, 8, 5833-5842.
(33) Chen, et al. *Nano Lett.* 2014, 14, 7201-7206.
(34) Young, et al. *Proc. Nat. Acad. Soc. U.S.A.* 2012, 109, 2240-2245.
(35) Rodriguez-Fernandez, et al. *J. Phys. Chem. B* 2005, 109, 14257-14261.
(36) Hong, et al. *Chem. Mater.* 2011, 23, 2011-2013.
(37) Niu, et al. *J. Am. Chem. Soc.* 2009, 131, 697-703.
(38) Hong, et al. *Chem. Mater.* 2014, 26, 3618-3623.

(39) Link, et al. *J. Phys. Chem. B* 1999, 103, 8410-8426.
(40) Hartland. *Chem. Rev.* 2011, 111, 3858-3887.
(41) Blaber, et al. *The Journal of Physical Chemistry C* 2012, 116, 393-403.
(42) Munechika, et al. *The Journal of Physical Chemistry C* 2007, 111, 18906-18911.
(43) Purcell, et al. *Astrophysical Journal* 1973, 186, 705-714.
(44) Draine, et al. *J. Opt. Soc. Am. A* 1994, 11, 1491-1499.
(45) Yurkin, et al. *J. Quant. Spectrosc. Radiat. Transfer* 2007, 106, 558-589.
(46) Scarabelli, et al. *ACS Nano* 2014, 8, 5833-5842.
(47) Ali, et al. *Langmuir* 2012, 28, 9807-9815.
(48) Glotzer, et al. *Nat. Mater.* 2007, 6, 557-562.
(49) Bishop, et al. *Small* 2009, 5, 1600-1630.
(50) Shevchenko, et al. *Nature* 2006, 439, 55-59.
(51) Jones, et al. *Nat. Mater.* 2010, 9, 913-917.
(52) Mirkin, et al. *Nature* 1996, 382, 607-609.
(53) Caswell, et al. *J. Am. Chem. Soc.* 2003, 125, 13914-13915.
(54) Jones, et al. *J. Am. Chem. Soc.* 2011, 133, 18865-18869.
(55) Macfarlane, et al. *Science* 2011, 334, 204-208.
(56) Walker, et al. *Nat Nano* 2013, 8, 676-681.
(57) O'Brien, et al. *Angew. Chem. Int. Ed.* 2014, 53, 9532-9538.

Spherical Nanoparticle Seeds (1) Tao et al. *Small* 2008, 4, 310.
(2) Xia, et al. *Angew. Chem. Int. Ed.* 2009, 48, 60.
(3) Personick, et al. *J. Am. Chem. Soc.* 2013, 135, 18238.
(4) Lohse, et al. *Chem. Mater.* 2014, 26, 34.
(5) Lofton, et al. *Adv. Funct Mater.* 2005, 15, 1197.
(6) Elechiguerra, et al. *J. Mater. Chem.* 2006, 16, 3906.
(7) Langille, et al. *Science* 2012, 337, 954.
(8) Brown, et al. *Chem. Mater.* 2000, 12, 306.
(9) Gole, et al. *Chem. Mater.* 2004, 16, 3633.
(10) Rodriguez-Fernandez, et al. *J. Phys. Chem. B* 2005, 109, 14257.
(11) Tsung, et al. *J. Am. Chem. Soc.* 2006, 128, 5352.
(12) Niu, et al. *J. Am. Chem. Soc.*2009, 131, 697.
(13) Hong, et al. *Chem. Mater.* 2011, 23, 2011.
(14) Lee, et al. *ACSNano* 2013, 7, 11064.
(15) Nikoobakht, et al. *Chem. Mater.* 2003, 15, 1957.
(16) Liu; et al. *J. Phys. Chem. B* 2005, 109, 22192.
(17) Murray, et al. *J. Am. Chem. Soc.* 1993, 115, 8706.
(18) Dabbousi, et al. *J. Phys. Chem. B* 1997, 101, 9463.
(19) Ghosh Chaudhuri, et al. *Chem. Rev.* 2012, 112, 2373.
(20) Sau, et al. *J. Am. Chem. Soc.* 2004, 126, 8648.
(21) Seo, et al. *J. Am. Chem. Soc.* 2006, 128, 14863.
(22) Langille, et al. *J. Am. Chem. Soc.* 2012, 134, 14542.
(23) Sohn, et al. *ACSNano* 2009, 3, 2191.
(24) Wu, et al. *Langmuir* 2010, 26, 12307.
(25) Link, et al. *J. Phys. Chem. B* 1999, 103, 8410.
(26) Link, et al. *J. Phys. Chem. B* 1999, 103, 4212.
(27) Ming, et al. *J. Am. Chem. Soc.* 2009, 131, 16350.
(28) Zhang, et al. *J. Am. Chem. Soc.* 2010, 132, 14012.
(29) Personick, et al. *Nano Lett.* 2011, 11, 3394.
(30) Lu, et al. *J. Am. Chem. Soc.* 2011, 133, 18074.
(31) Jones, et al. *Angew. Chem., Int. Ed.* 2013, 52, 2886.
(32) Liao, et al. *Chem. Mater.* 2005, 17, 4636.
(33) Orendorff, et al. *J. Phys. Chem. B* 2006, 110, 3990.
(34) Near, et al. *J. Phys. Chem. C* 2013, 117, 23950.

What is claimed is:

1. A method of preparing gold circular disk nanoparticle comprising (a) admixing gold triangular prisms, a stabilizing agent, and an oxidizing agent in an aqueous solution to form a first intermediate;

(b) admixing the first intermediate, a gold salt, and a reducing agent, and optionally a base and halide salt, in an aqueous solution to form a second intermediate;

(c) admixing the second intermediate, a stabilizing agent, and oxidizing agent in an aqueous solution to form the gold circular disk nanoparticle; and (d) optionally repeating steps (b) and (c) at least once to increase the uniformity of the resulting circular disk nanoparticles;

wherein the gold circular disk nanoparticles are formed in a yield of at least 70%.

2. The method of claim 1, wherein the gold circular disk nanoparticles are formed in a yield of at least 90%.

3. The method of claim 1, wherein the circular disk nanoparticles having uniformity as measured by a coefficient of variation (CV) of less than 30%.

4. The method of claim 3, wherein the circular disk nanoparticles have a CV of 10% or less.

5. The method of claim 1, wherein the oxidizing agent of steps (a) and (c) comprises $HAuCl_4$.

6. The method of claim 5, wherein the $HAuCl_4$ concentration correlates to the gold triangular prism edge length: at 8 μM for an edge length of 60 nm or less; at 10 μM for an edge length of 80 nm to 120 nm; at 12 μM for an edge length of 140nm; and at 13 μM for an edge length of 180 nm.

7. The method of claim 1, wherein the stabilizing agent is selected from the group consisting of cetyltrimethylammonium bromide (CTAB), cetyltrimethylammonium chloride (CTAC), cetylpyridinium chloride (CPC), and a mixture thereof.

8. The method of claim 1, wherein the gold salt comprises $HAuCl_4$.

9. The method of claim 1, wherein the reducing agent comprises ascorbic acid.

10. The method of claim 1, wherein steps (b) and (c) are repeated at least twice.

11. The method of claim 1, wherein the gold triangular prisms are prepared by (1) admixing a stabilizing agent, an iodide salt, a gold salt, a base, a reducing agent, and nanoparticle seeds to form gold triangular prisms; and (2) isolating the gold triangular prisms.

12. The method of claim 11, wherein the concentration of nanoparticle seeds is 20 to 300 pM for a selected edge length of the gold triangular prism of 30 nm to 250 nm.

13. The method of claim 1, wherein the isolating comprises adding a halide salt to the mixture resulting from step (1) and the concentration of the halide salt is selected in view of the edge length of the gold triangular prisms: 0.4M halide salt for triangular prisms with an edge length of 30 nm to 80 nm; 0.2M halide salt for triangular prisms with an edge length of 90 nm to 120 nm; 0.1M halide salt for triangular prisms with an edge length of 130 nm to 170 nm; and 0.05M halide salt for triangular prisms with an edge length of 180 nm to 250 nm.

14. A method of preparing uniform gold spherical nanoparticles comprising (a) admixing gold nanorods, a stabilizing agent, and an oxidizing agent in an aqueous solution to form a first intermediate;

(b) admixing the first intermediate, a gold salt, and a reducing agent, and optionally a base and halide salt, in an aqueous solution to form a second intermediate;

(c) admixing the second intermediate, a stabilizing agent, and an oxidizing agent in an aqueous solution to form the gold spherical nanoparticles; and (d) optionally repeating steps (b) and (c) at least once to increase the uniformity of the resulting gold spherical nanoparticles, as measured by a coefficient of variation (CV); wherein (1) the method is performed in the absence of ethylene glycol, dimethylformamide, diethylene glycol, dimethylsulfoxide, toluene, tetrahydrofuran, hexane, octane, and oleic acid;

(2) the gold spherical nanoparticles are formed in a yield of at least 90%; and (3) the gold spherical nanoparticles have a diameter of 1 nm to 99 nm.

15. The method of claim 14, wherein the spherical nanoparticles have a CV of 3% or less.

16. The method of claim 14, wherein the oxidizing agent of steps (a) and (c) comprises $HAuCl_4$.

17. The method of claim 14, wherein the gold salt comprises $HAuCl_4$.

18. The method of claim 14, wherein the reducing agent comprises ascorbic acid.

19. The method of claim 14, wherein any one of step (a), (b), and (c) is performed for 0.5 hr to 2 hr.

20. The method of claim 19, wherein each of step (a), (b), and (c) is performed for 0.5 hr to 6 hr.

* * * * *